US009445642B2

(12) United States Patent
Avar et al.

(10) Patent No.: US 9,445,642 B2
(45) Date of Patent: Sep. 20, 2016

(54) INTERCHANGEABLE INSERT SYSTEM WITH SLEEVE MEMBERS FOR FOOTWEAR

(71) Applicant: Nike, Inc., Beaverton, OR (US)

(72) Inventors: Eric P. Avar, Lake Oswego, OR (US); Olivier Henrichot, Lake Oswego, OR (US); Jeffrey C. Spanks, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 323 days.

(21) Appl. No.: 14/152,348

(22) Filed: Jan. 10, 2014

(65) Prior Publication Data

US 2014/0182168 A1 Jul. 3, 2014

Related U.S. Application Data

(63) Continuation of application No. 13/151,054, filed on Jun. 1, 2011, now Pat. No. 8,677,653.

(51) Int. Cl.

| | |
|---|---|
| ***A43C 11/00*** | (2006.01) |
| ***A43B 3/24*** | (2006.01) |
| ***A43B 5/00*** | (2006.01) |
| ***A43B 19/00*** | (2006.01) |

(52) U.S. Cl.

CPC ..... *A43B 3/24* (2013.01); *A43B 3/242* (2013.01); *A43B 19/00* (2013.01)

(58) Field of Classification Search

CPC ..... A43B 3/242; A43B 3/24; A43B 5/00; A43B 19/00; A43B 13/14; A61F 5/0111

USPC ..... 36/10, 89, 91

See application file for complete search history.

(56) References Cited

U.S. PATENT DOCUMENTS

| | | | |
|---|---|---|---|
| 4,183,156 | A | 1/1980 | Rudy |
| 4,219,945 | A | 9/1980 | Rudy |

(Continued)

FOREIGN PATENT DOCUMENTS

| | | | |
|---|---|---|---|
| CN | 1148542 | A | 4/1997 |
| CN | 101125043 | A | 2/2008 |

(Continued)

OTHER PUBLICATIONS

Response to Office Action filed Apr. 24, 2015 in European Patent Application No. 12 741 128.8.

(Continued)

*Primary Examiner* — Jila M Mohandesi

(74) *Attorney, Agent, or Firm* — Plumsea Law Group, LLC

(57) ABSTRACT

An insert system for an article of footwear includes an outer assembly, a first insert assembly and a second insert assembly. The outer assembly is configured to interchangeably receive the first insert assembly and the second insert assembly. The first insert assembly includes a first sleeve member and a first midsole configured to provide enhanced cushioning and support. The first sleeve member includes a tongue and a fastening member that wraps around the tongue. The second insert assembly includes a second sleeve member and a second midsole configured to enhance speed. The second sleeve member is open at a forefoot portion and at a heel portion. The outer assembly includes an aperture on a sidewall of an outer sole portion, where the midsole inserted within the outer assembly is visible through the aperture.

13 Claims, 15 Drawing Sheets

(56) References Cited

U.S. PATENT DOCUMENTS

| | | | | |
|---|---|---|---|---|
| 4,370,818 | A | 2/1983 | Simoglou | |
| 4,621,648 | A * | 11/1986 | Ivany | A43B 5/00 36/89 |
| 4,736,531 | A | 4/1988 | Richard | |
| 5,243,772 | A | 9/1993 | Francis et al. | |
| 5,444,926 | A | 8/1995 | Allen et al. | |
| 5,673,448 | A | 10/1997 | Lang et al. | |
| 5,713,141 | A | 2/1998 | Mitchell et al. | |
| 5,775,008 | A | 7/1998 | Bussell et al. | |
| 5,893,219 | A | 4/1999 | Smith et al. | |
| 5,952,065 | A | 9/1999 | Mitchell et al. | |
| 5,964,047 | A | 10/1999 | Covatch | |
| 6,013,340 | A | 1/2000 | Bonk et al. | |
| 6,023,857 | A | 2/2000 | Vizy et al. | |
| 6,023,859 | A | 2/2000 | Burke et al. | |
| 6,082,025 | A | 7/2000 | Bonk et al. | |
| 6,127,026 | A | 10/2000 | Bonk et al. | |
| 6,203,868 | B1 | 3/2001 | Bonk et al. | |
| 6,321,465 | B1 | 11/2001 | Bonk et al. | |
| 6,923,781 | B2 * | 8/2005 | Gardner | A61F 5/0111 128/882 |
| 7,115,105 | B2 * | 10/2006 | Cropper | A61F 5/0111 602/27 |
| 7,131,218 | B2 | 11/2006 | Schindler | |
| 7,171,768 | B2 | 2/2007 | Klein | |
| 7,210,249 | B2 | 5/2007 | Passke et al. | |
| 7,210,251 | B1 | 5/2007 | Rolle | |
| 7,294,114 | B1 * | 11/2007 | Clement | A61F 5/0195 36/15 |
| 7,370,442 | B2 | 5/2008 | Jung et al. | |
| 7,409,779 | B2 | 8/2008 | Dojan et al. | |
| 7,426,792 | B2 | 9/2008 | Swigart et al. | |
| 7,428,789 | B2 | 9/2008 | Holzer et al. | |
| 7,444,763 | B2 | 11/2008 | Grove et al. | |
| 7,451,557 | B2 | 11/2008 | McDonald et al. | |
| 7,475,500 | B2 | 1/2009 | Covatch | |
| 7,543,399 | B2 | 6/2009 | Kilgore et al. | |
| 7,578,076 | B2 | 8/2009 | Pawlus et al. | |
| 7,588,654 | B2 | 9/2009 | Schindler et al. | |
| 7,591,084 | B2 | 9/2009 | Santa Ana | |
| 7,591,919 | B2 | 9/2009 | Schindler et al. | |
| 7,631,440 | B2 * | 12/2009 | Keen | A43B 1/14 36/50.1 |
| 7,758,528 | B2 | 7/2010 | Buethorn | |
| 7,836,612 | B2 * | 11/2010 | Agnew | A43B 5/0405 36/10 |
| 7,856,742 | B2 | 12/2010 | Nguyen et al. | |
| 7,887,081 | B2 | 2/2011 | Brandt | |
| 7,908,772 | B2 | 3/2011 | Celia | |
| 7,908,774 | B2 | 3/2011 | Mirza et al. | |
| 7,918,811 | B2 | 4/2011 | Lussier et al. | |
| 8,151,486 | B2 | 4/2012 | Dua | |
| 8,241,451 | B2 | 8/2012 | Rapaport et al. | |
| 8,250,692 | B2 | 8/2012 | Sills | |
| 8,381,418 | B2 | 2/2013 | Peyton | |
| 8,464,439 | B2 | 6/2013 | Monfils et al. | |
| 8,470,113 | B2 | 6/2013 | Beye et al. | |
| 8,479,412 | B2 | 7/2013 | Peyton et al. | |
| 8,591,440 | B2 * | 11/2013 | Logue | A61F 5/0111 602/13 |
| 8,622,946 | B2 * | 1/2014 | Ingimundarson | A61F 5/0127 128/882 |
| 8,677,653 | B2 | 3/2014 | Avar et al. | |
| 8,821,427 | B1 * | 9/2014 | Weber | A61F 5/0111 602/23 |
| 2005/0098917 | A1 | 5/2005 | Chiu | |
| 2006/0196083 | A1 | 9/2006 | Martin et al. | |
| 2007/0271822 | A1 | 11/2007 | Meschter | |
| 2007/0271823 | A1 | 11/2007 | Meschter | |
| 2008/0005933 | A1 | 1/2008 | Auger et al. | |
| 2008/0229614 | A1 | 9/2008 | Santa Ana | |
| 2008/0244930 | A1 | 10/2008 | Rivas et al. | |
| 2009/0045546 | A1 | 2/2009 | Schindler et al. | |
| 2009/0100713 | A1 | 4/2009 | Adami et al. | |
| 2009/0288312 | A1 | 11/2009 | Dua | |
| 2009/0288313 | A1 | 11/2009 | Rapaport et al. | |
| 2010/0236100 | A1 | 9/2010 | Ho | |
| 2011/0131831 | A1 | 6/2011 | Peyton et al. | |
| 2011/0271552 | A1 | 11/2011 | Peyton | |
| 2011/0277347 | A1 | 11/2011 | Monfils | |
| 2011/0277916 | A1 | 11/2011 | Beye et al. | |
| 2012/0102782 | A1 | 5/2012 | Swigart et al. | |
| 2012/0233878 | A1 | 9/2012 | Hazenberg et al. | |
| 2012/0233879 | A1 | 9/2012 | Dojan et al. | |
| 2012/0233880 | A1 | 9/2012 | Chao et al. | |
| 2012/0304498 | A1 | 12/2012 | Avar et al. | |

FOREIGN PATENT DOCUMENTS

| | | |
|---|---|---|
| CN | 101291601 A | 10/2008 |
| CN | 103747698 A | 4/2014 |
| JP | 5003802 | 1/1993 |
| WO | 2004043184 | 5/2004 |
| WO | 2012166869 | 12/2012 |

OTHER PUBLICATIONS

Response to Office Action filed Jun. 29, 2015 in Chinese Patent Application No. 201280027093.6.

Office Action issued Jan. 19, 2015 in European Patent Application No. 12741128.8.

Office Action issued Mar. 4, 2015 in Chinese Patent Application No. 201280027093.6.

International Search Report and Written Opinion mailed Oct. 22, 2012 in International Application No. PCT/US2012/040138.

International Preliminary Report on Patentability (including Written Opinion of the ISA) mailed Dec. 12, 2013 in International Application No. PCT/US2012/040138.

* cited by examiner

INTERCHANGEABLE INSERT SYSTEM WITH SLEEVE MEMBERS FOR FOOTWEAR

CROSS-REFERENCE TO RELATED APPLICATIONS

This application is a continuation of U.S. Pat. No. 8,677,653, currently U.S. application Ser. No. 13/151,054, entitled "Interchangeable Insert System for Footwear", filed on Jun. 1, 2011 and issued on Mar. 25, 2014, which application is hereby incorporated by reference in its entirety.

BACKGROUND

The present embodiments relate generally to articles of footwear, and in particular to articles of footwear with interchangeable insert assemblies.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

SUMMARY

In one aspect, a kit of parts includes an outer assembly with an upper portion and an outer sole portion. The upper portion includes an opening and a fastening region, where the fastening region can be used to change the size of the opening. The outer assembly can receive at least two different removable insert assemblies. The kit of parts also includes a first insert assembly includes a first sleeve member and a first midsole, where the first insert assembly can be removably inserted into the outer assembly. The kit of parts also includes a second insert assembly including a second sleeve member and a second midsole, where the second insert assembly can be removably inserted into the outer assembly, and where the second sleeve member is different from the first sleeve member. The first sleeve member includes a strap that can be used to adjust the fit of the sleeve member to a foot; where the first sleeve member has a first tongue portion and where the first tongue portion is covered by the strap when the strap is fastened. The second sleeve member has a second tongue portion and the second sleeve member is free of a strap in the second tongue portion.

In another aspect, an article of footwear includes an outer assembly with an upper portion and an outer sole portion, where the upper includes an outer opening. The article also includes a sleeve member configured to be removably inserted into the opening. The sleeve member includes a midfoot portion that covers a midfoot of a foot. The sleeve member is open forwards of the midfoot portion and the sleeve member is open rearwards of the midfoot portion.

In another aspect, a kit of parts includes an outer assembly with an upper portion and an outer sole portion permanently attached to the upper portion. The outer assembly can receive at least two different removable midsoles. The kit of parts includes a first removable midsole having a first color and a second removable midsole having a second color that is different from the first color. The outer sole portion includes an outsole extending along the bottom of the outer sole portion and an outer sidewall portion. The outer sole portion includes at least one aperture open on the sidewall portion of the outer sole portion and the at least one aperture is spaced apart from the outsole of the outer sole portion. The first color is visible through the at least one aperture when the first removable midsole is inserted within the outer assembly and the second color is visible through the at least one aperture when the second removable midsole is inserted within the outer assembly.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
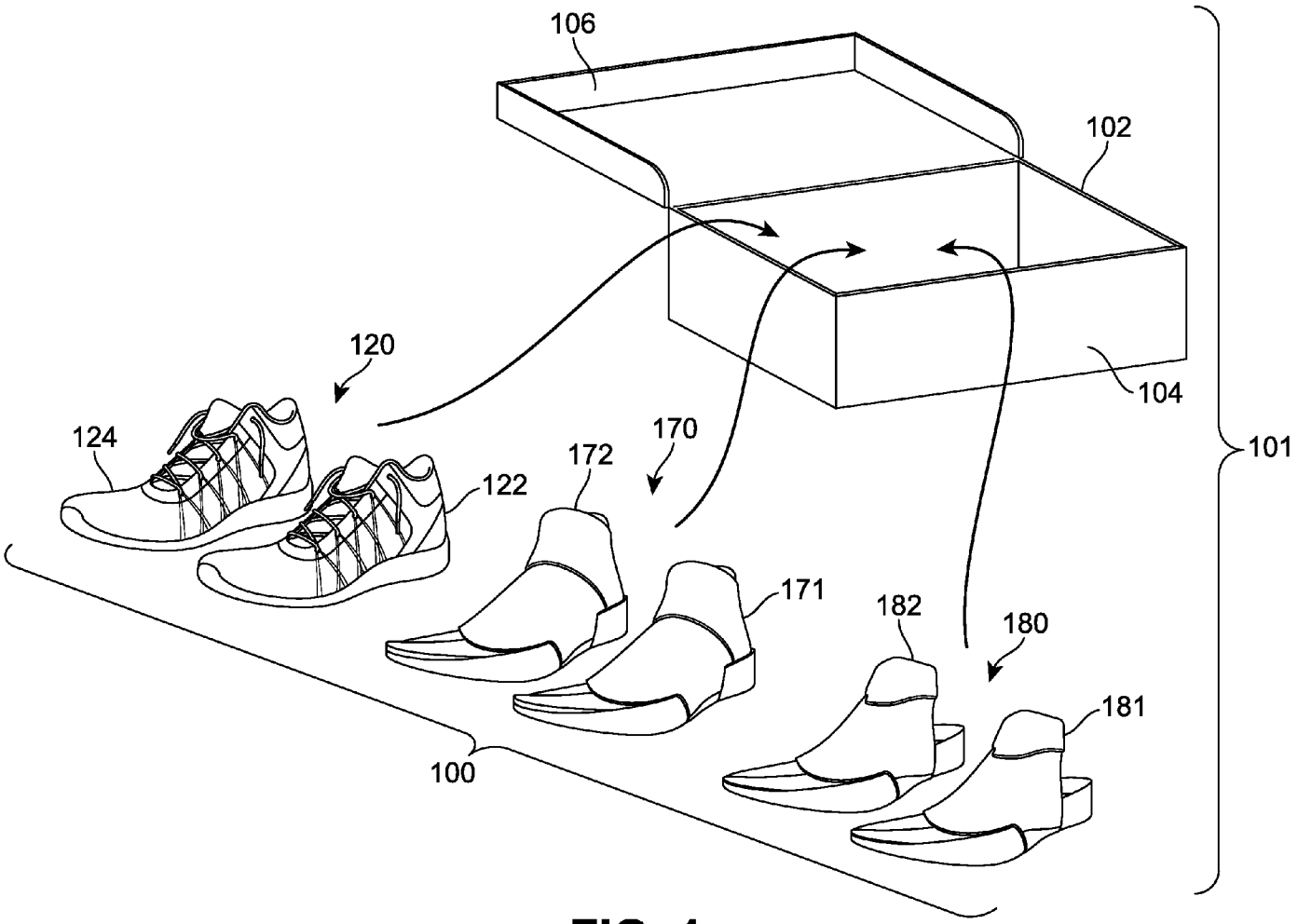
FIG. 1 is an isometric view of an embodiment of a kit of parts including a pair of outer assemblies and two pairs of insert assemblies.

FIG. 1 illustrates an isometric view of kit of parts 101, or simply kit 101. In some cases, kit 101 may comprise one or more articles of footwear, accessories for these articles and/or a container for storing the articles. In other cases, kit 101 could include any other provisions not discussed below including, but not limited to: instructions, various kinds of media (such as CDs, DVDs, etc.), additional storage containers for storing articles and/or article accessories as well as any other provisions.

Generally, articles of footwear associated with kit 101 can be any type of footwear. For clarity, the following detailed description discusses articles of footwear in the form of sports shoes, but it should be noted that in other embodiments any other type of footwear could be used including, but not limited to: hiking boots, soccer shoes, football shoes, sneakers, rugby shoes, basketball shoes, baseball shoes as well as other kinds of shoes. Articles of footwear associated with kit 101 may also take the form of any non-athletic shoe, including, but not limited to: dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

Kit 101 may be offered for sale at a retail location, such as a retail store, kiosk, factory outlet, manufacturing store and/or through an online vendor. In some cases, the various parts of kit 101 are sold together. In other cases, however, some parts of kit 101 may be sold separately. As an example, the current embodiment describes a kit of parts including a pair of outer assemblies and two pairs of corresponding insert assemblies. In some cases, a retailer could sell a kit including the footwear and two pairs of insert assemblies and the retailer could also sell one or more pairs of insert assemblies separately from kit 101.

Kit 101 may include container 102. Container 102 can be any type of container configured to store at least one article of footwear. In some cases, container 102 may be a box. In an exemplary embodiment, container 102 may be a shoebox that is configured to store footwear. In particular, container 102 may have a generally rectangular shape and can include lower portion 104 and lid 106. In other embodiments, container 102 could be a bag, sack or other type of container. In still other embodiments, the various items in kit 101 may not be provided in a container.

In some embodiments, kit 101 includes articles of footwear that comprise various interchangeable components. In some cases, kit 101 may include an outer assembly. The term "outer assembly" as used throughout this detailed description and in the claims refers to any outer structure for an article of footwear including, but not limited to, an upper portion as well as an outer sole portion, as described in further detail below. In other embodiments, various other components could also be associated with an outer assembly. Moreover, an outer assembly can be configured to receive one or more insert assemblies, which may be inserted into the outer assembly in order to provide enhanced internal structure. The term "insert assembly" as used throughout this detailed description and in the claims, refers to any combination of internal components for an article of footwear that can be inserted into an outer assembly. Examples of components that may be incorporated into an insert assembly include, but are not limited to: booties, sleeves, bands, straps, midsole structures, insole structures as well as any other components. In some cases, each insert assembly could be associated with different types of structures in order to allow a user to vary the degree of support, cushioning, flexibility, durability, sensory feedback, including proprioception, as well as any other characteristics of an article of footwear. The term proprioception as used through this detailed description and in the claims refers to the sense of awareness of the relative positions of different parts of the body. Throughout the remainder of this detailed description, the term article of footwear may refer to an outer assembly and/or a combination of an outer assembly with an insert assembly.

In one embodiment, kit 101 includes pair of outer assemblies 120 that includes first outer assembly 122 and second outer assembly 124. First outer assembly 122 and second outer assembly 124 may be oriented for a left foot and a right foot, respectively. For purposes of clarity, the following detailed description discusses first outer assembly 122, but it will be understood that each of the features discussed for first outer assembly 122 could also apply to second outer assembly 124. Furthermore, first outer assembly 122 may also be referred to as outer assembly 122 throughout the remainder of this detailed description.

Figure 2:
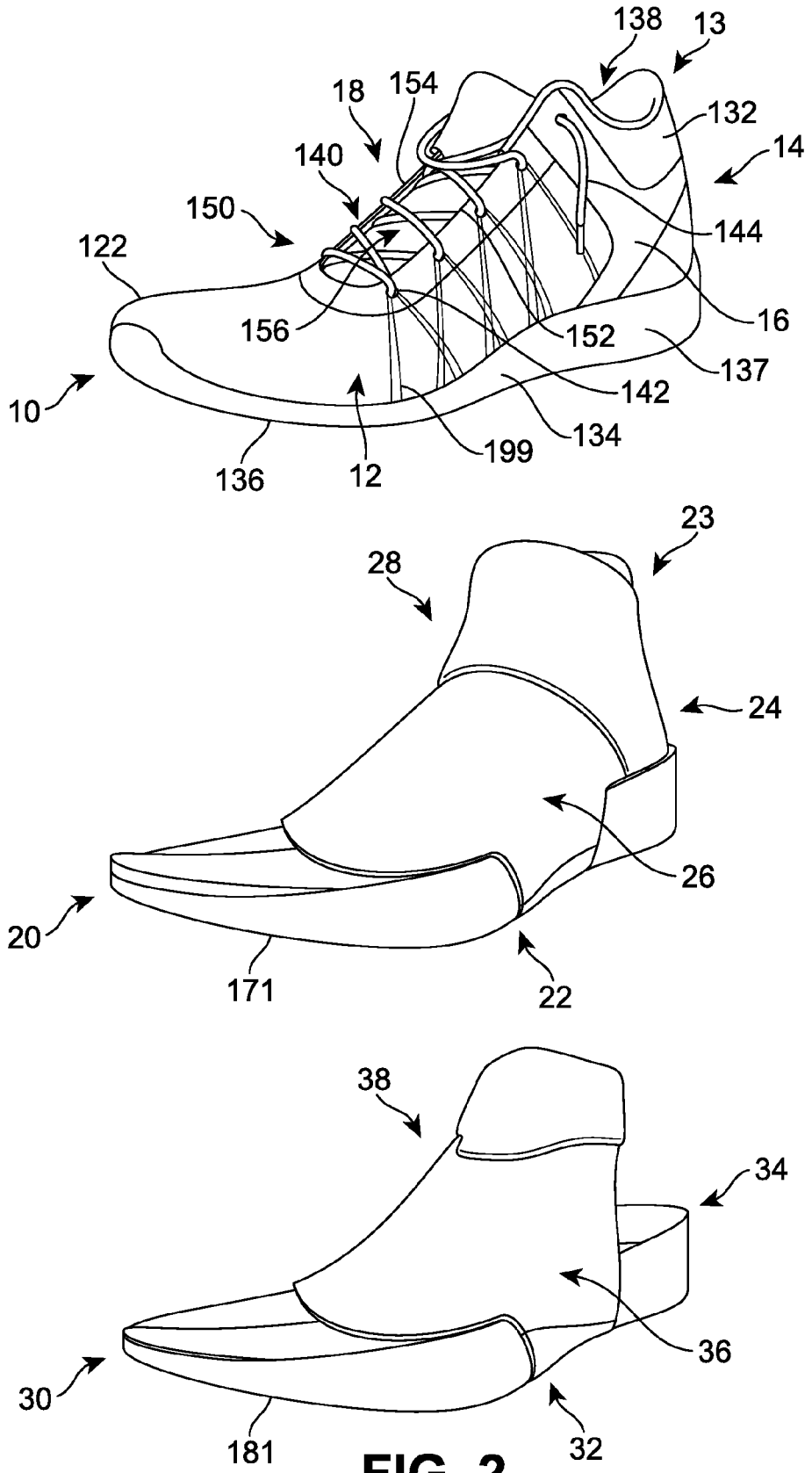
FIG. 2 is an isometric view of an embodiment of an outer assembly and two different insert assemblies.

FIG. 2 illustrates isometric views of some components of kit of parts 101. Referring now to FIG. 2, outer assembly 122 can include upper portion 132. In some cases, upper portion 132 may be substantially similar to uppers found in some other kinds of footwear. For example, upper portion 132 can include opening 138 that provides entry for a foot into an interior cavity of upper portion 132. In some cases, opening 138 may be disposed at the ankle region of upper portion 132. However, in other cases, opening 138 could be disposed in any other region of upper portion 132. Additionally, the size of opening 138 may be controlled using fastening system 140.

Generally, upper portion 132 could have any design, shape, size and/or color. For example, in embodiments where kit 101 provides components for a basketball shoe, upper portion 132 could be configured as a high top upper that is shaped to provide high support on an ankle. In embodiments where kit 101 provides components for a running shoe, upper portion 132 could be configured as low top upper. In the current embodiment, upper portion 132 may be configured as a mid-top type upper that can be used in basketball shoes as well as other types of footwear.

In one embodiment, fastening region 150 of upper portion 132 includes first fastening edge 152 and second fastening edge 154 that are separated by gap 156. In embodiments where fastening system 140 is a lacing system, first fastening edge 152 and second fastening edge 154 can include plurality of eyelets 142 for receiving lace 144. Using this arrangement, as lace 144 is tightened upper portion 132 may be tightened around a foot. Although the current embodiment uses a lacing system, in other embodiments fastening system 140 could make use of any other kinds of fasteners for footwear including, but not limited to: zippers, button, snaps, straps, cords as well as any other fasteners known in the art for fastening footwear.

In contrast to some kinds of uppers, in some cases, upper portion 132 may not include a tongue. Instead, a tongue or tongue like portion can be provided on one or more insert assemblies so that the properties of a tongue for an article of footwear can be varied. In such embodiments, portions of an insert assembly could be visible through gap 156. In other embodiments, however, upper portion 132 could include a tongue.

In addition to a fastening system, in other embodiments, upper portion 132 could include various other provisions to enhance the structural properties of upper 132 as well as to add aesthetic features. In one embodiment, for example, upper 132 could be provided with one or more threaded structures that extend from eyelets 142 and towards the bottom of upper portion 132. Articles with threads configured to provide structural support have been previously disclosed in U.S. Patent Application Publication No. 2007/0271822, to Meschter, the entirety of which is hereby incorporated by reference. In addition, U.S. Patent Application Publication No. 2007/0271823, also to Meschter, is hereby incorporated by reference. In one embodiment, upper portion 132 includes threaded structures 199 that extend from eyelets 142 towards outer sole portion 134 (discussed below).

Outer assembly 122 can also include outer sole portion 134. In some embodiments, outer sole portion 134 may be configured to provide traction for outer assembly 122. In addition to providing traction, outer sole portion 134 may attenuate ground reaction forces when compressed between the foot and the ground during walking, running or other ambulatory activities. The configuration of outer sole portion 134 may vary significantly in different embodiments to include a variety of conventional or non-conventional structures. In some cases, the configuration of outer sole portion 134 can be configured according to one or more types of ground surfaces on which outer sole portion 134 may be used. Examples of ground surfaces include, but are not limited to: natural turf, synthetic turf, dirt, as well as other surfaces.

In different embodiments, outer sole portion 134 may include different components. For example, in some embodiments, outer sole portion 134 may include an outsole, a midsole, and/or an insole. In some embodiments, outer sole portion 134 could comprise a shell like outsole portion that receives a midsole and/or insole. For example, in one embodiment, outer sole portion 134 can include outsole 136 that extends along the bottom of outer assembly 122 and engages a ground surface. Moreover, outer sole portion 134 can include outer sidewall portions 137 that enclose an interior portion of outer sole portion 134.

Referring back to FIG. 1, kit 101 can include first pair of insert assemblies 170 and second pair of insert assemblies 180. First pair of insert assemblies 170 includes first insert assembly 171 and second insert assembly 172 that correspond to first outer assembly 122 and second outer assembly 124, respectively. Second pair of insert assemblies 180 includes first insert assembly 181 and second insert assembly 182 that correspond to first outer assembly 122 and second outer assembly 124, respectively. A user may select a corresponding pair of insert assemblies to use with outer assemblies 120 to form a pair of footwear that may be used in various athletic activities.

For purposes of clarity, the following description discusses first insert assembly 171 and first insert assembly 181 in detail. However, it will be understood that second insert assembly 172 may be substantially similar to first insert assembly 171 in many respects. Likewise, it will be understood that second insert assembly 182 may be substantially similar to first insert assembly 181 in many respects. Moreover, throughout the remainder of this detailed description first insert assembly 171 and first insert assembly 181 may be referred to simply as insert assembly 171 and insert assembly 181, respectively.

A component associated with an article of footwear may be described by reference to various portions, such as a "forefoot portion", a "midfoot portion", a "heel portion" and an "ankle portion". The forefoot portion may be generally associated with the toes and joints connecting the metatarsals with the phalanges. The midfoot portion may be generally associated with the arch and/or middle of a foot. Likewise, the heel portion may be generally associated with the heel of a foot, including the calcaneus bone. The ankle portion may generally be associated with the ankle of a foot. In addition, an article of footwear and/or insert assembly can also be described by reference to a "lateral side" and a "medial side". The lateral side and medial side may be opposing sides of a component. Furthermore, both the lateral side and the medial side may extend through the forefoot portion, midfoot portion, ankle portion and heel portion.

For example, referring to FIG. 2, outer assembly 122 can include forefoot portion 10, midfoot portion 12, ankle portion 13 and heel portion 14. Article 122 can also include lateral side 16 and medial side 18. In addition, insert assembly 171 can include forefoot portion 20, midfoot portion 22, ankle portion 23 and heel portion 24, as well as lateral side 26 and medial side 28. Likewise, insert assembly 181 includes forefoot portion 30, midfoot portion 32, and heel portion 34 as well as lateral side 36 and medial side 38.

It will be understood that the terms forefoot portion, midfoot portion, ankle portion and heel portion are only intended for purposes of description and are not intended to demarcate precise regions of an outer assembly, insert assembly or other footwear component. Likewise, the terms lateral side and medial side are intended to represent generally two sides of a component, rather than precisely demarcating the component into two halves.

For consistency and convenience, directional adjectives are employed throughout this detailed description corresponding to the illustrated embodiments. These terms are used with various components including, but not limited to: an article of footwear, an outer assembly, an upper portion, an outer sole portion, an insert assembly as well as any other components of an article of footwear. The term "longitudinal" as used throughout this detailed description and in the claims refers to a direction extending a length or major axis of a component. In some cases, the longitudinal direction may extend from a forefoot portion to a heel portion of the component. Also, the term "lateral" as used throughout this detailed description and in the claims refers to a direction extending a width or minor axis of a component. In other words, the lateral direction may extend between a medial side and a lateral side of a component. Furthermore, the term "vertical" as used throughout this detailed description and in the claims refers to a direction generally perpendicular to a lateral and longitudinal direction. For example, in cases where an article of footwear is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn.

As shown in FIG. 1, pair of outer assemblies 120, first pair of insert assemblies 170 and second pair of insert assemblies 180 may be collectively referred to as interchangeable insert system 100. The term interchangeable insert system as used throughout this detailed description and in the claims refers to two or more pairs of removable insert assemblies that can be used with a single pair of outer assemblies to form a pair of footwear. For example, in the current embodiment, first insert assembly 171 of first pair of insert assemblies 170 and first insert assembly 181 of second pair of insert assemblies 180 can be used in an interchangeable manner with first outer assembly 122. Likewise, second insert assembly 172 of first pair of insert assemblies 170 and second insert assembly 182 of second pair of insert assemblies 180 can be used in an interchangeable manner with second outer assembly 124. Although each pair of insert assemblies includes different provisions, as discussed in detail below, they are configured so that either first pair of insert assemblies 170 or second pair of insert assemblies 180 can be used with pair of outer assemblies 120 according to the preference and/or needs of a user. This allows for enhanced versatility for a user, since the combination of an outer assembly with different insert assemblies can provide varying levels of support, cushioning, comfort, sensory awareness, proprioception, flexibility as well as other footwear characteristics.

In some embodiments, pair of outer assemblies 120, first pair of insert assemblies 170 and second pair of insert assemblies 180 could be packaged together within container 102 as shown in FIG. 1. However, in other embodiments, other arrangements of outer assemblies 120, insert assemblies 170 and insert assemblies 180 are possible. In some cases, for example, each pair of insert assemblies could be placed in an individual container, such as a cloth bag or plastic box that fits within container 102. In some cases, one pair of insert assemblies may be inserted into outer assemblies 120 while stored in container 102. In still other embodiments, outer assemblies 120 may be packaged separately from insert assemblies 170 and insert assemblies 180, though these components may still be offered for sale together as interchangeable insert system 100.

An interchangeable insert system can include provisions that allow a user to modify various footwear characteristics provided by an article of footwear. The term "footwear characteristics" as used throughout this detailed description and in the claims includes, but is not limited to: support, rigidity, flexibility, cushioning, comfort, proprioception, energy return as well as various other kinds of characteristics. In some cases, one type of insert assembly may be configured to provide characteristics that enhance performance in situations where a user may be running or sprinting. For example, an insert assembly can include a midsole with relatively high rigidity that provides a great deal of energy return in a similar manner to a track shoe. In addition, the insert may facilitate proprioception in the midfoot, but little to no feedback at the heel or ankle. This allows a user to receive some sensory information but not too much to be overwhelmed during running or sprinting, where a user may require less foot awareness. In contrast, another insert assembly can be configured to provide footwear characteristics that enhance performance in situations where a user may require increased cushioning and support. In such cases, the insert assembly can include a midsole having a relatively low rigidity to enhance cushioning. In addition, the insert assembly can provide proprioception at the midfoot, heel and ankle portions to enhance awareness of foot position.

Figure 3:
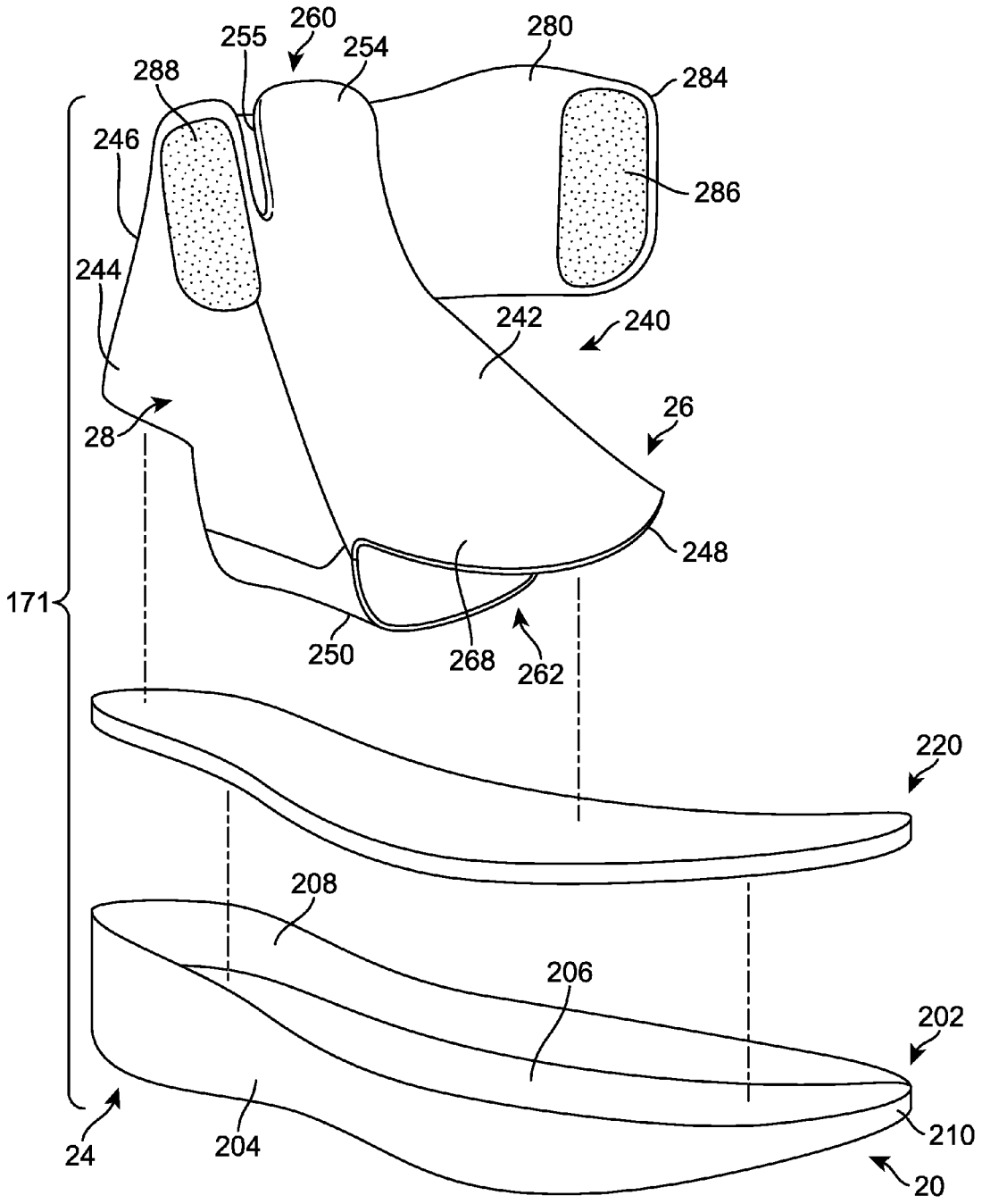
FIG. 3 is an exploded isometric view of an embodiment of an insert assembly.
Figure 4:
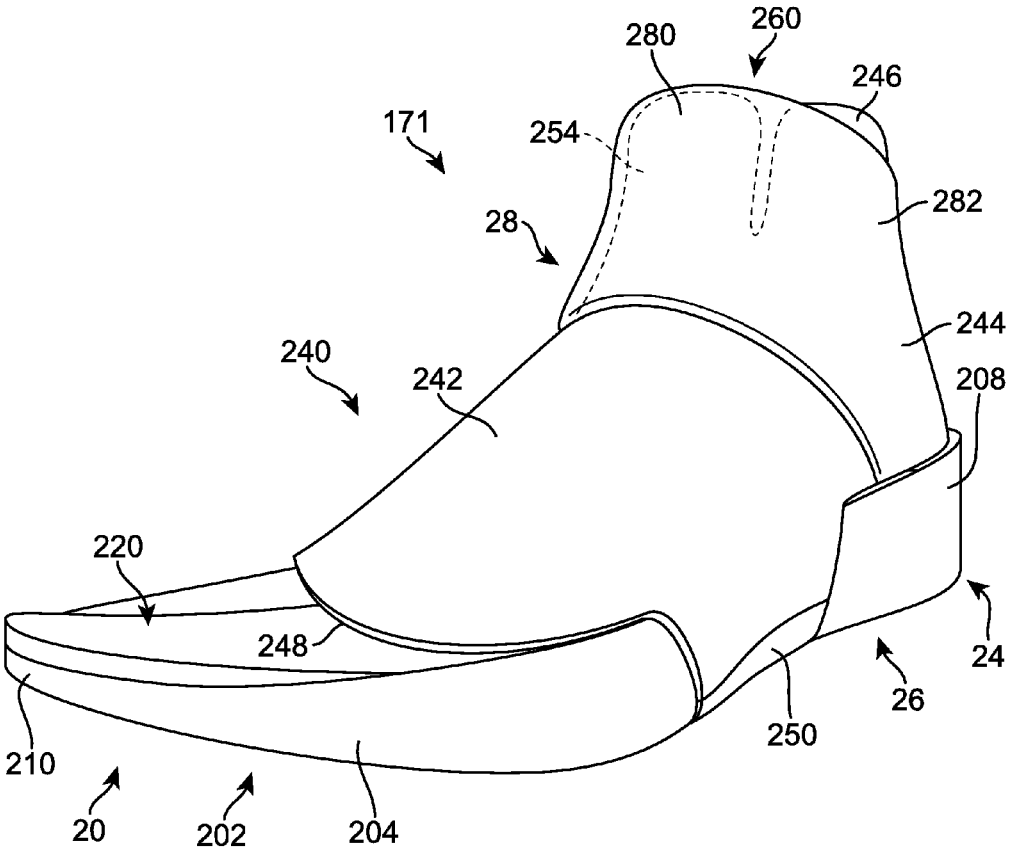
FIG. 4 is an isometric view of an embodiment of a lateral side of an insert assembly.
Figure 5:
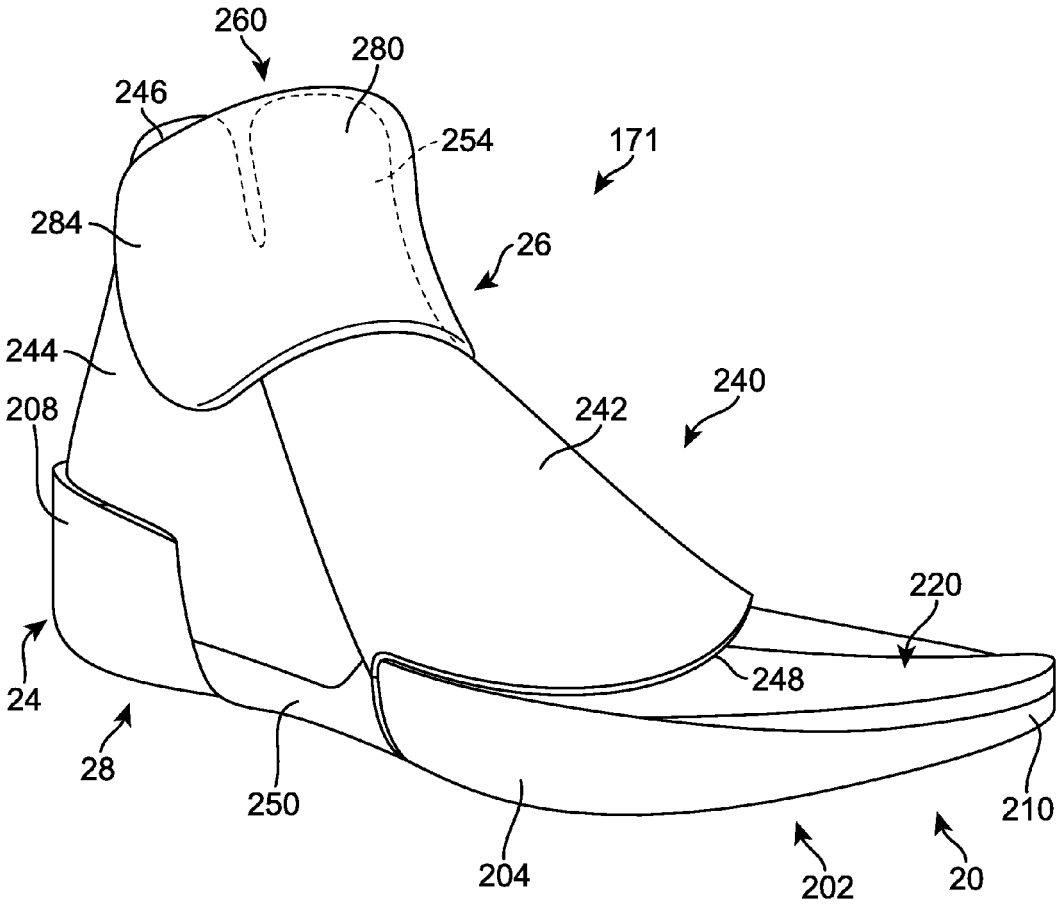
FIG. 5 is an isometric view of an embodiment of a medial side of an insert assembly.

FIGS. 3 through 5 illustrate isometric views of an embodiment of insert assembly 171. In particular, FIG. 3 illustrates an exploded isometric view of an embodiment of insert assembly 171, while FIGS. 4 and 5 illustrate a lateral isometric view and a medial isometric view, respectively, of an embodiment of insert assembly 171. Insert assembly 171 can be configured to provide various footwear characteristics including cushioning, support, comfort and proprioception.

In some embodiments, insert assembly 171 can include first midsole 202. First midsole 202 may comprise outer surface 204 and inner surface 206. In addition, first midsole 202 includes raised perimeter portion 208 that extends from heel portion 24 to forefoot portion 20. In some cases, raised perimeter portion 208 may taper in height from heel portion 24 towards forefoot portion 20. In other cases, however, the height of perimeter portion 208 could vary in any other manner. In one embodiment, perimeter portion 208 may provide increased heel support for first midsole 202 at heel portion 24. For example, in some cases, perimeter portion 208 may function as a heel cup at heel portion 24.

In some embodiments, insert assembly 171 can also include insole 220. In some cases, insole 220 may be disposed against inner surface 206 of midsole 202. In some cases, insole 220 can provide increased comfort for the foot. Also, in some cases, insole 220 can improve breathability and/or help to reduce moisture through the use of particular materials and/or structural features. In other cases, insert assembly 171 may not include an insole.

In some embodiments, insert assembly 171 can include first sleeve member 240. The term "sleeve member" as used throughout this detailed description and in the claims refers to any member configured to wrap around or otherwise cover some of a foot. In some cases, a sleeve member could be a full length bootie that fully encloses a foot. In other cases, however, a sleeve member could provide partial coverage of a foot. First sleeve member 240 may be configured to wrap around a portion of a foot in order to secure midsole 202 to the foot. In some cases, first sleeve member 240 comprises a substantially flexible material. In some cases, first sleeve member 240 may be made of an elastic material to stretch and conform to the shape of the foot.

Generally, the size and shape of first sleeve member 240 can be selected to achieve desired footwear characteristics including support and proprioception. For example, by selectively shaping first sleeve member 240 to cover some parts of a foot, but not others, first sleeve member 240 may be tuned to deliver sensory feedback to specific regions of the foot. This can be useful for enhancing the awareness of a user regarding different regions of the foot such as the midfoot and/or ankle. Specifically, in some situations, as a user moves his or her foot, the contact with first sleeve member 240 can provide targeted proprioception at specific locations on the foot.

In some embodiments, first sleeve member 240 includes midfoot portion 242 that extends around the midfoot of a foot. In some embodiments, first sleeve member 240 also includes heel portion 244 and ankle portion 246 for extending around the heel and ankle, respectively, of a foot. In some cases, first sleeve member 240 may not extend into the forefoot region of a foot. For example, in one embodiment, forward most edge 248 of first sleeve member 240 may be disposed rearwardly of forward most edge 210 of first midsole 202. In other embodiments, first sleeve member 240 could have any other shape and could include portions associated with any portions of a foot, including the heel, midfoot, arch, ankle, instep, forefoot as well as any other portions. The particular configuration for first sleeve member 240 discussed here may provide enhanced proprioception at the midfoot and ankle. Such sensory feedback can be useful in helping a user maintain awareness of the location of one or more regions of the foot, such as the ankle.

In some embodiments, sleeve member 240 includes tongue portion 254. Tongue portion 254 extends up from midfoot portion 242 towards and into ankle portion 246. In some cases, tongue portion 254 may include slots 255 that provide some separation between tongue portion 254 and adjacent regions of ankle portion 246. This allows tongue portion 254 to move somewhat independently from ankle portion 246, thereby allowing a user to adjust the positioning of sleeve member 240 by pulling on tongue portion 254.

In some embodiments, first sleeve member 240 includes lower extending portion 250 that is configured to wrap around outer surface 204 of first midsole 202. In some cases, extending portion 250 could be permanently attached to first midsole 202. For example, in some cases, extending portion 250 may be attached to outer surface 204 using an adhesive. In other cases, other methods of attaching extending portion 250 to first midsole 202 could be used. In still other cases, extending portion 250 may not be permanently attached to first midsole 202.

As seen in FIGS. 3-5, first sleeve member 240 includes opening 260 at ankle portion 246 that is configured to allow entry of a foot into first sleeve member 240. In some cases, opening 260 may be aligned with opening 138 of first outer assembly 122 (see FIG. 2). Additionally, as seen in FIG. 3, first sleeve member 240 includes opening 262 at lower portion 268. Therefore, as a foot is inserted into first sleeve member 240, opening 262 allows the foot to come into direct contact with insole 220 and/or a portion of first midsole 202.

In some embodiments, first sleeve member 240 can also include fastening member 280. In some cases, fastening member 280 could be a strap. In other cases, however, fastening member 280 could be any other kind of fastening mechanism known in the art for fastening a component of an article of footwear. For example, in another embodiment, fastening member 280 could comprise a lace.

In one embodiment, fastening member 280 comprises an ankle strap that extends around ankle portion 246. In some cases, first end portion 282 of fastening member 280 is permanently attached at lateral side 28 of first sleeve member 240. Second end portion 284 of fastening member 280 may include first fastening portion 286 that engages second fastening portion 288 on medial side 28 of first sleeve member 240. In some cases, first fastening portion 286 and second fastening portion 288 could be corresponding sides of a hook and loop fastener system, such as Velcro©. In other cases, however, first fastening portion 286 and second fastening portion 288 could comprise corresponding portions of any other kind of fasteners including, but not limited to: buttons, snaps, zippers, interlocking tabs, cinching mechanisms, as well as any other means of fastening a strap. As seen in FIGS. 4 and 5, with fastening member 280 in a fastened position, fastening member 280 may be disposed over tongue portion 254 of first sleeve member 240.

Figure 6:
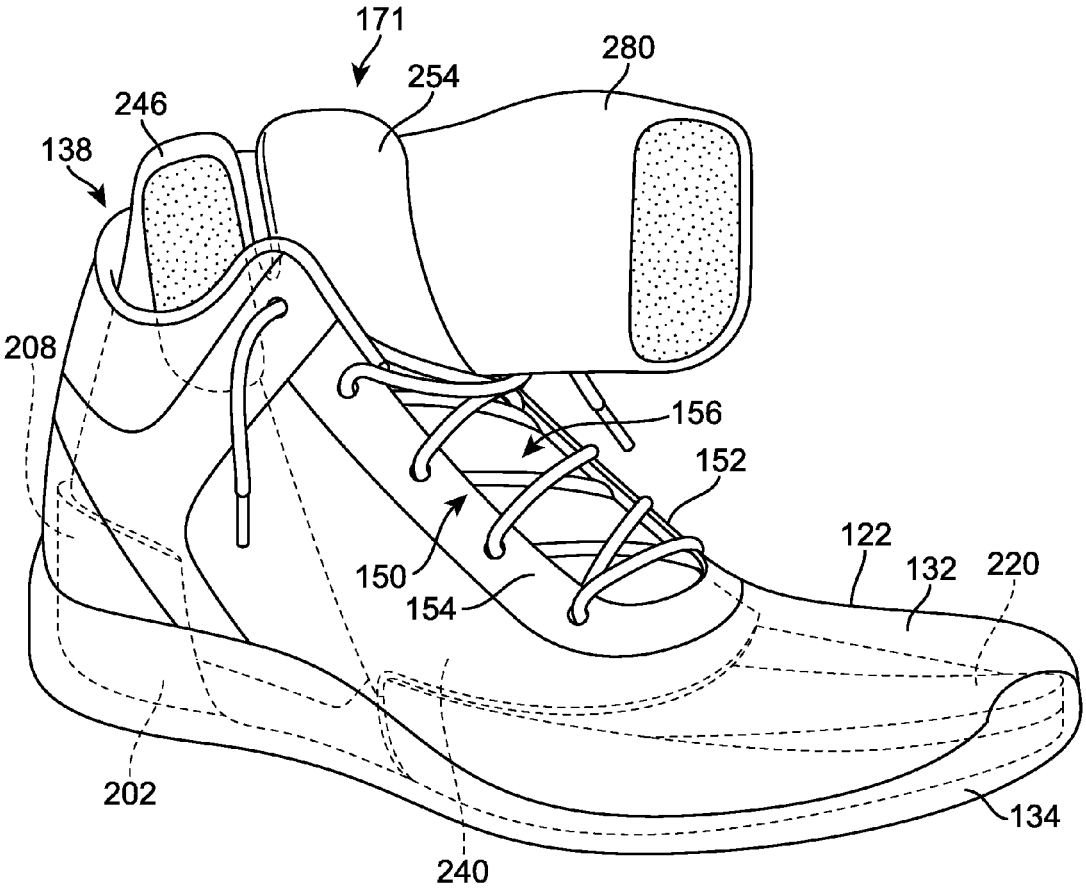
FIG. 6 is an isometric view of an embodiment of an insert assembly inserted into an outer assembly with the fastening system of the outer assembly unfastened and a fastening member of the insert assembly unfastened.
Figure 7:
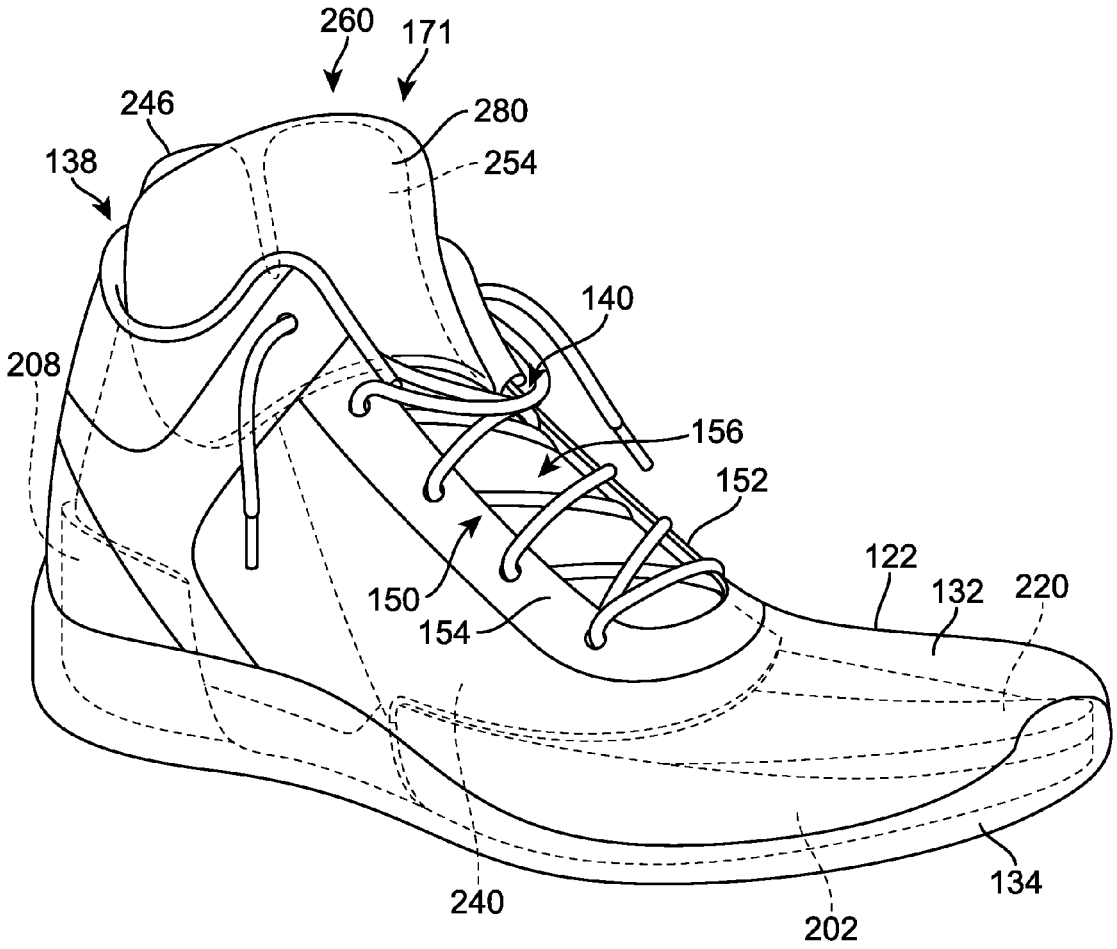
FIG. 7 is an isometric view of an embodiment of an insert assembly inserted into an outer assembly with the fastening system of the outer assembly unfastened and a fastening member of the insert assembly fastened.
Figure 8:
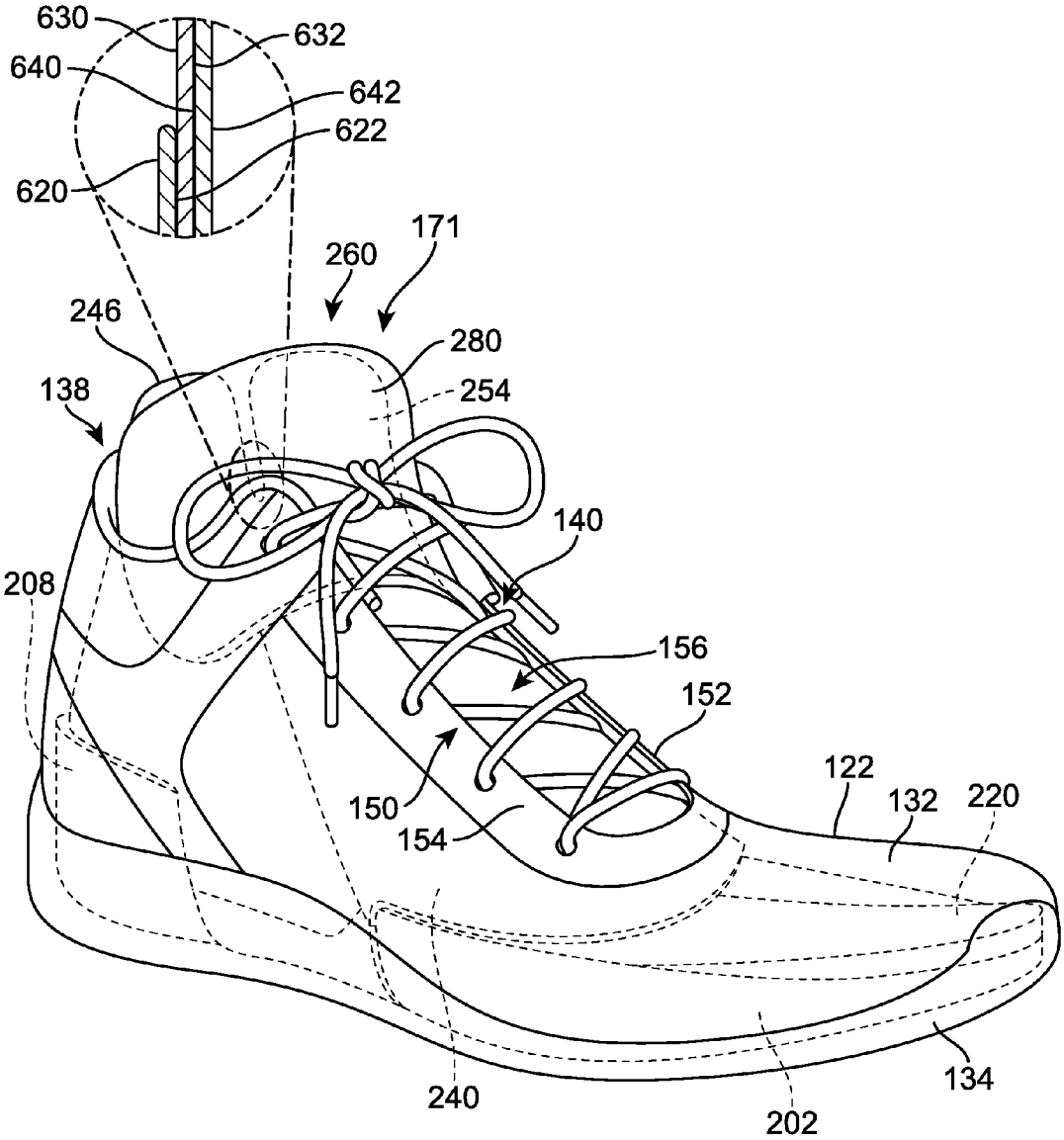
FIG. 8 is an isometric view of an embodiment of an insert assembly inserted into an outer assembly with the fastening system of the outer assembly fastened and a fastening member of the insert assembly fastened.

FIGS. 6 through 8 illustrate isometric views of an embodiment of first insert assembly 171 placed within first outer assembly 122. For purposes of illustration, the portions of first insert assembly 171 that are disposed within first outer assembly 122 and normally hidden from view are shown in phantom in these Figures. As seen in FIG. 6, first midsole 202 and first insole 220 are disposed within outer sole portion 134 and positioned to provide support to the lower surface of a foot. Moreover, in some cases, perimeter portion 208 of first midsole 202 provides enhanced heel support. In some cases, perimeter portion 208 may extend into the interior cavity of upper portion 132.

First sleeve member 240 may be positioned to receive the midfoot portion of a foot. In some cases, ankle portion 246 may extend through opening 138 of upper portion 132. Also, in some cases, tongue portion 254 is aligned beneath gap 156 of fastening region 150, including both first fastening edge 152 and second fastening edge 154. By aligning tongue portion 254 with fastening region 150, tongue portion 254 can help protect a foot from experiencing undesirable pressure from fastening system 140.

As seen in FIG. 7, to fully secure first insert assembly 171 to a foot, fastening member 280 may be fastened around ankle portion 246. This helps to tighten opening 260 around a foot. With first insert assembly 171 fully secured to a foot, a user may then use fastening system 140 to tighten opening 138 of outer assembly 122 around a foot, as seen in FIG. 8. This helps to secure outer assembly 122 to the foot.

For purposes of understanding the arrangement of upper portion 132, fastening member 280 and tongue portion 254, a cross sectional portion of these components is shown in an enlargement within FIG. 8. Upper portion 132 comprises outer surface 620 and inner surface 622. Fastening member 280 comprises outer surface 630 and inner surface 632. Tongue portion 254 comprises outer surface 640 and inner surface 642. In one embodiment, outer surface 630 of fastening member 280 may be disposed adjacent to inner surface 622 of upper portion 132. Additionally, inner surface 632 of fastening member 280 may be disposed adjacent to outer surface 640 of tongue portion 254. Thus, upper portion 132 is disposed distally from fastening member 280 and tongue portion 254. Likewise, fastening member 280 is disposed distally from tongue portion 254.

With the arrangement shown in FIGS. 7 and 8, fastening member 280 is disposed around tongue portion 254. In some cases, fastening member 280 may be disposed over tongue portion 254 and beneath first fastening edge 152 and second fastening edge 154. Using this configuration, first outer assembly 122 and first insert assembly 171 are simultaneously secured to a foot, especially around an ankle. Moreover, by fastening first sleeve member 240 directly to the foot at ankle portion 246, the ability of first sleeve member 240 to provide enhanced proprioception to the midfoot and ankles of the foot are greatly enhanced. Furthermore, in some cases, this arrangement can enhance support of the foot at the ankle.

Figure 9:
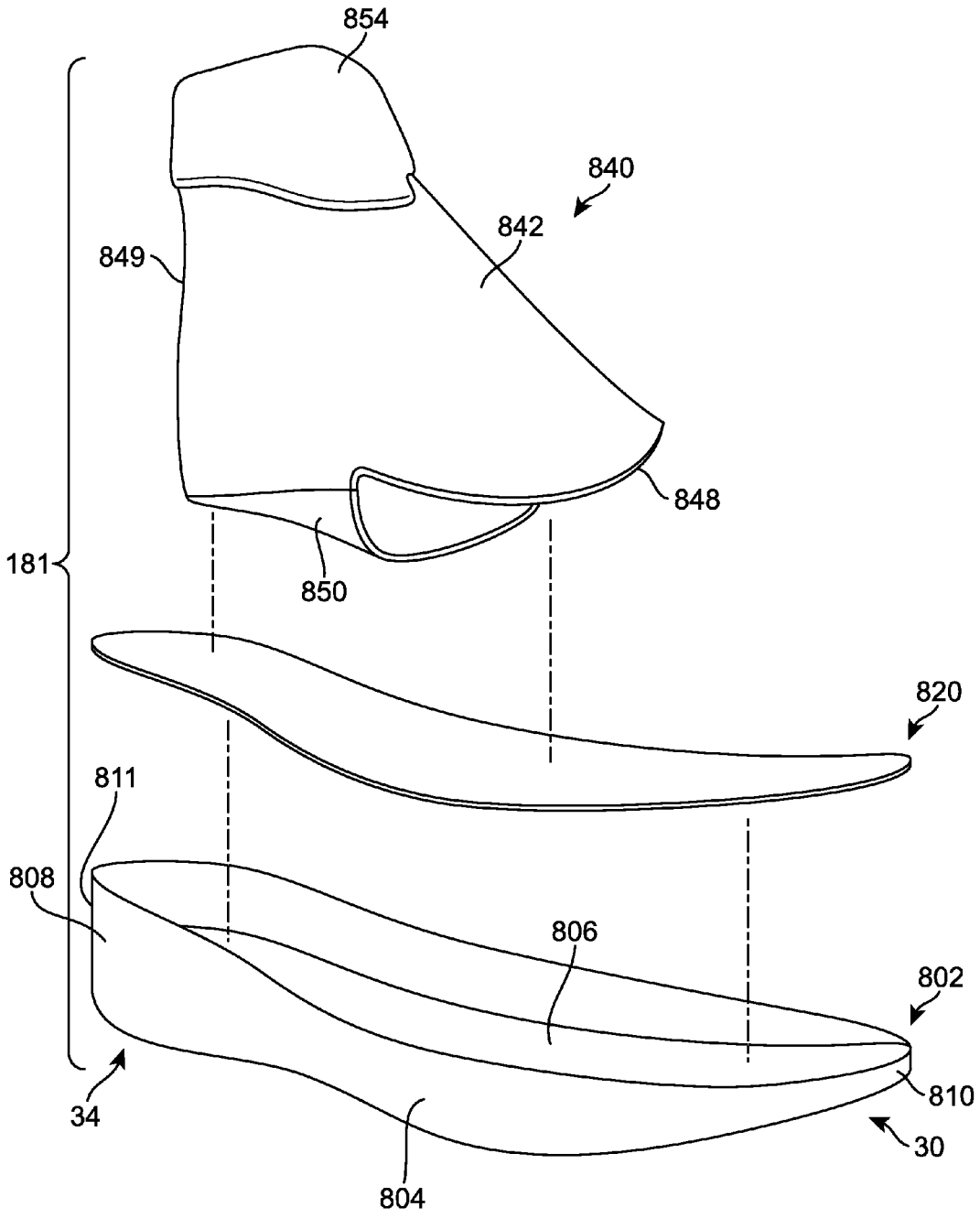
FIG. 9 is an isometric exploded view of an embodiment of an insert assembly.
Figure 10:
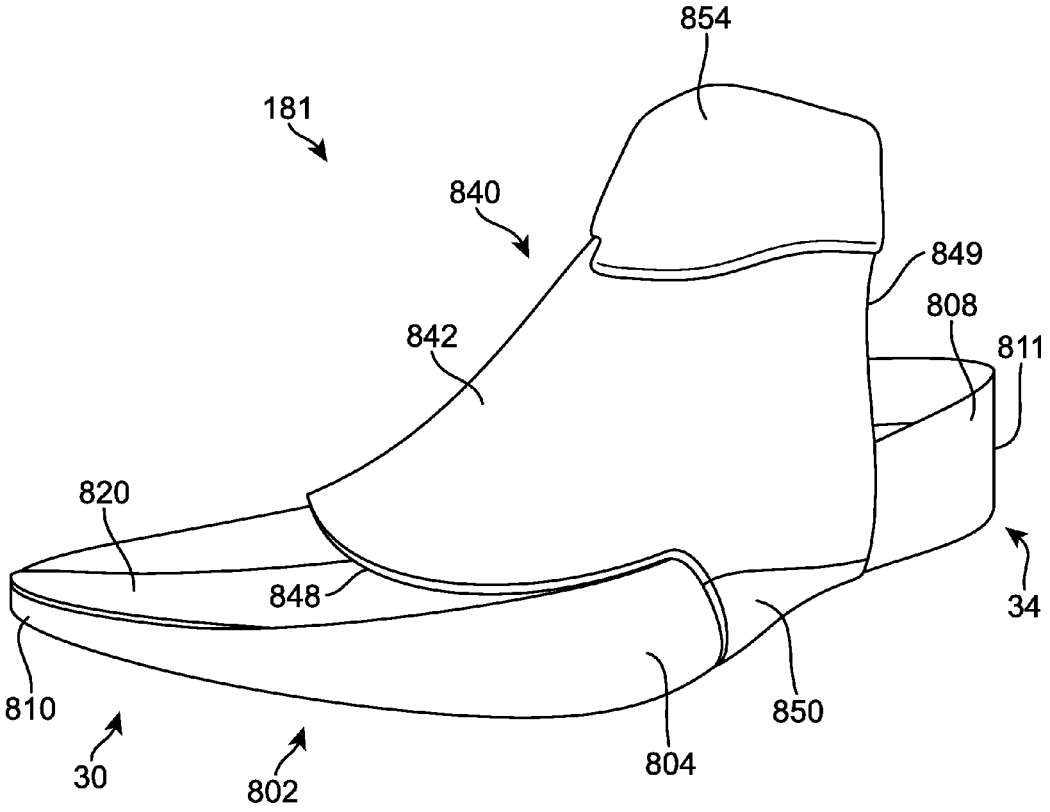
FIG. 10 is a front isometric view of an embodiment of an insert assembly.
Figure 11:
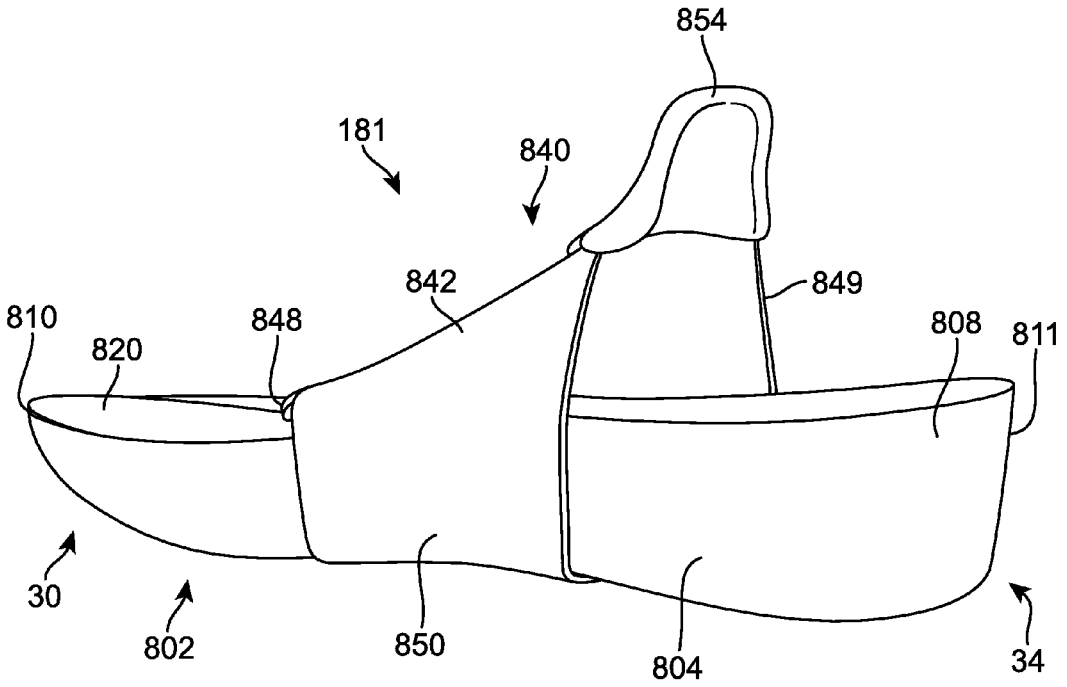
FIG. 11 is a rear isometric view of an embodiment of an insert assembly.

FIGS. 9 through 11 illustrate isometric views of an embodiment of insert assembly 181. In particular, FIG. 9 illustrates an exploded isometric view of an embodiment of insert assembly 181, while FIGS. 10 and 11 illustrate a front isometric view and a rear isometric view, respectively, on an embodiment of insert assembly 181. Insert assembly 181 can be configured to provide various footwear characteristics including good firmness and energy return as well as some proprioception in the midfoot.

In some embodiments, insert assembly 181 can include second midsole 802. Second midsole 802 may comprise outer surface 804 and inner surface 806. In addition, second midsole 802 includes raised perimeter portion 808 that extends from heel portion 34 to forefoot portion 30. In some cases, raised perimeter portion 808 may taper in height from heel portion 34 towards forefoot portion 30. In other cases, however, the height of perimeter portion 808 could vary in any other manner. In one embodiment, perimeter portion 808 may provide increased heel support for second midsole 802 at heel portion 34. For example, in some cases, perimeter portion 808 may function as a heel cup at heel portion 34.

In some embodiments, insert assembly 181 can also include insole 820. In some cases, insole 820 may be disposed against inner surface 806 of midsole 802. In some cases, insole 820 can provide increased comfort for the foot. Also, in some cases, insole 820 can improve breathability and/or help to reduce moisture through the use of particular materials and/or structural features. In other cases, insert assembly 181 may not include an insole.

In some embodiments, insert assembly 181 can include second sleeve member 840. Second sleeve member 840 may be configured to wrap around a portion of a foot in order to secure midsole 802 to the foot. In some cases, second sleeve member 840 comprises a substantially flexible material. In some cases, second sleeve member 840 may be made of an elastic material to stretch and conform to the shape of the foot.

Generally, the size and shape of second sleeve member 840 can be selected to achieve desired footwear characteristics including support and targeted proprioception. For example, by selectively shaping second sleeve member 840 to cover some parts of a foot, but not others, second sleeve member 840 may be tuned to achieve proprioception at specific regions of the foot. This can be useful for enhancing the awareness of a user regarding different regions of the foot such as the midfoot. Specifically, in some situations, the contact of the foot with second sleeve member 840 can provide proprioception, at specific locations on the foot.

In some embodiments, second sleeve member 840 includes midfoot portion 842 that extends around the midfoot of a foot. In some cases, second sleeve member 840 may not extend into the forefoot region of a foot. For example, in one embodiment, forward most edge 848 of second sleeve member 840 may be disposed rearwardly of forward most edge 810 of second midsole 802. In some cases, second sleeve member 840 may not cover the heel or ankle regions of a foot. For example, in one embodiment, rearward most edge 849 of sleeve member 840 may not extend all the way to rearward most edge 811 of second midsole 802. In other embodiments, second sleeve member 840 could have any other shape and could include portions associated with any portions of a foot, including the heel, midfoot, arch, ankle, instep, forefoot as well as any other portions. The particular configuration for second sleeve member 840 discussed here may provide enhanced proprioception at the midfoot and ankle. By enhancing proprioception, this configuration can be useful in helping a user to achieve desired types of movements, while avoiding others.

In some embodiments, second sleeve member 840 includes tongue portion 854. Tongue portion 854 extends outwardly from midfoot portion 842. In some cases, tongue portion 854 can comprise a thickened and/or padded portion that helps to cushion the top of the foot from fastening system 140 of outer assembly 122 (see FIG. 12).

In some embodiments, second sleeve member 840 includes lower extending portion 850 that is configured to wrap around outer surface 804 of second midsole 802. In some cases, extending portion 850 could be permanently attached to first midsole 802. For example, in some cases, extending portion 850 may be attached to outer surface 804 using an adhesive. In other cases, other methods of attaching extending portion 850 to first midsole 802 could be used. In still other cases, extending portion 850 may not be permanently attached to first midsole 802. With this arrangement, second sleeve member 840 acts to secure the bottom of a foot to insole 820 and/or a portion of second midsole 802.

Figure 12:
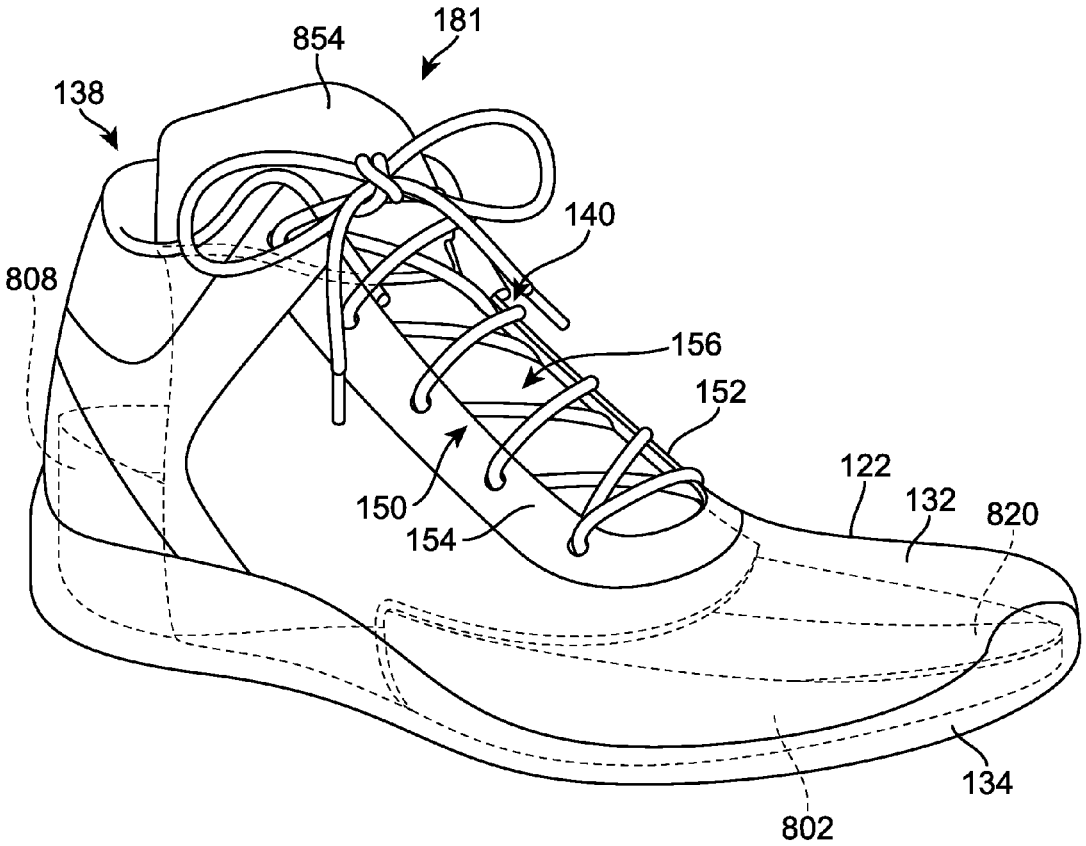
FIG. 12 is an isometric view of an embodiment of an insert assembly disposed within an outer assembly.

FIG. 12 illustrates an isometric view of an embodiment of first insert assembly 181 placed within first outer assembly 122. For purposes of illustration, the portions of first insert assembly 181 that are disposed within first outer assembly 122 and normally hidden from view are shown in phantom in these Figures. As seen in FIG. 12, second midsole 802 and second insole 820 are disposed within outer sole portion 134 and positioned to provide support to the lower surface of a foot. Moreover, in some cases, perimeter portion 808 of second midsole 802 provides enhanced heel support. In some cases, perimeter portion 808 may extend into the interior cavity of upper portion 132.

Second sleeve member 840 may be positioned to receive the midfoot portion of a foot. In some cases, tongue portion 854 is aligned beneath gap 156 of fastening region 150, including both first fastening edge 152 and second fastening edge 154. By aligning tongue portion 854 with fastening region 150, tongue portion 854 can facilitate protecting a foot from experiencing undesirable pressure from fastening system 140.

With first insert assembly 181 fully secured to a foot, a user may then use fastening system 140 to tighten opening 138 of outer assembly 122 around a foot, as seen in FIG. 12. This helps to secure outer assembly 122 to the foot. With second sleeve member 840 secured around the midfoot, second sleeve member 840 may provide some proprioception to a user.

Figure 13:
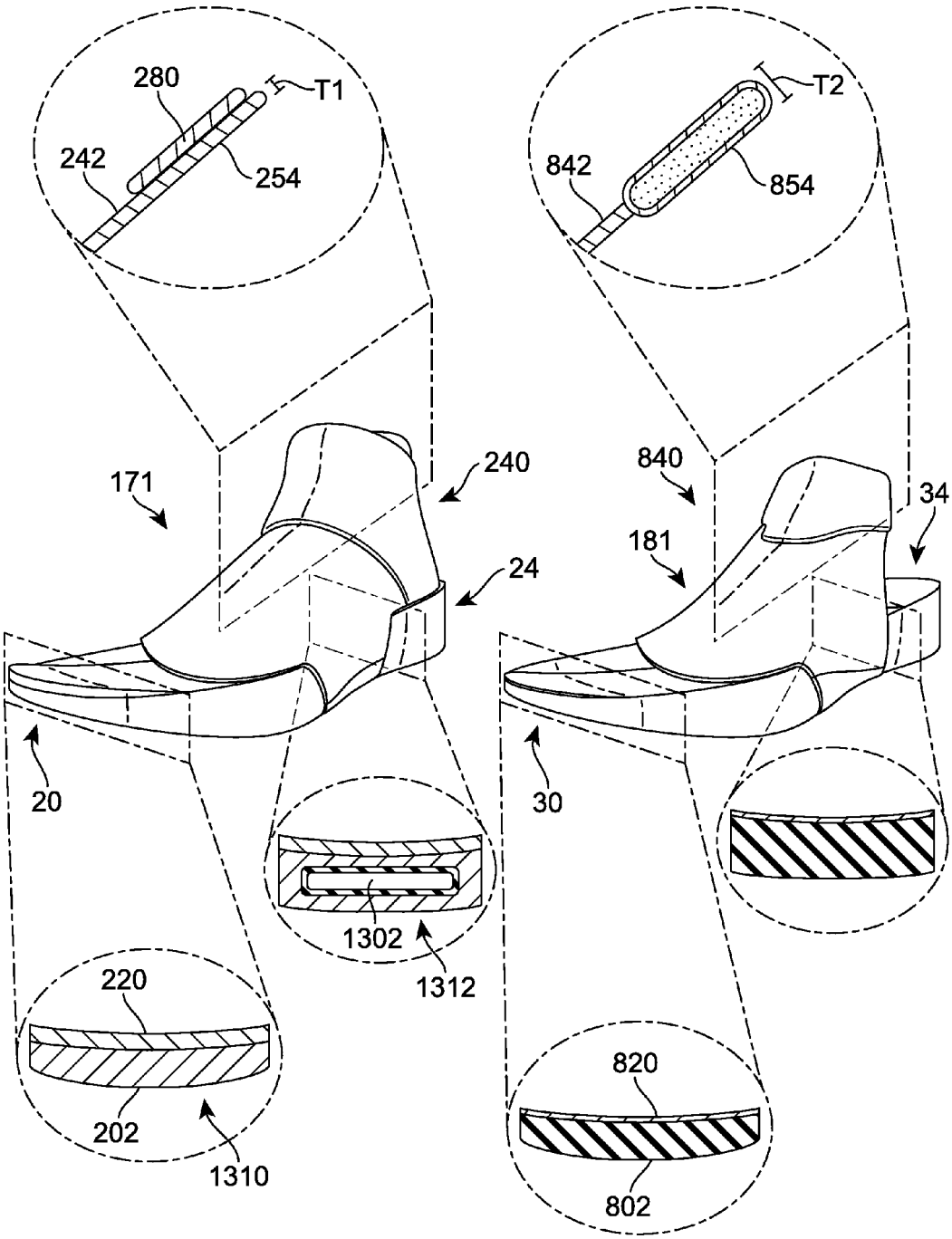
FIG. 13 is an isometric view of an embodiment of two different insert assemblies.

FIG. 13 illustrates isometric views of insert assembly 171 and insert assembly 181 for the purposes of showing various differences between the two types of insert assemblies. In some cases, each different insert assembly may be configured with different material and/or structural features in order to tune the insert assembly to provide predetermined footwear characteristics.

In some embodiments, the relative sizes of first sleeve member 240 and second sleeve member 840 provide different degrees of proprioception for a user. As seen in FIG. 13, first sleeve member 240 has a first size and second sleeve member 840 has a second size. In some cases, the first size may be substantially greater than the second size. In other cases, the first size may be substantially less than the second size. In still other cases, the first size may be substantially similar to the second size. In one embodiment, sleeve member 240 is configured with a first size to extend over the midfoot, ankle and at least part of the heel of a foot. In one embodiment, sleeve member 840 is configured with a second size to extend over the midfoot of a foot. This arrangement allows for a greater amount of proprioception for first sleeve member 240 since first sleeve member 240 covers a greater surface area of the foot than second sleeve member 840.

In some embodiments, the thicknesses of a tongue portion can vary between different types on insert assemblies. As seen in FIG. 13, tongue portion 254 of first sleeve member 240 has a thickness T1. Moreover, in some cases, the thickness sleeve member 240 is approximately constant from midfoot portion 242 to tongue portion 254. In contrast, tongue portion 854 of second sleeve member 840 has thickness T2. Moreover, in some cases, the thickness of second sleeve member 840 substantially increases from midfoot portion 842 to tongue portion 854.

In some cases, thickness T1 and thickness T2 could be substantially similar. In still other cases, thickness T1 is substantially greater than thickness T2. In one embodiment, thickness T1 is substantially less than thickness T2. By using a relatively thin tongue portion 254 for first sleeve member 240, outer assembly 122 may be more easily fastened around tongue portion 254 and fastening member 280, which wraps around tongue portion 254. However, since second sleeve member 840 lacks an overlapping fastening member, the increased relative thickness of tongue portion 854 helps provide the necessary cushioning at the fastening region 150 of outer assembly 122 (see FIG. 12).

In some embodiments, the thickness of an insole can vary between two different types of insert assemblies. In one embodiment, first insole 220 may comprise a relatively thick insole as compared to second insole 820. This may facilitate increased cushioning for first insert assembly 171. In other embodiments, second insole 820 could be thicker than first insole 220. In still other embodiments, first insole 220 and second insole 820 could have a substantially similar thickness.

In some embodiments, some of the material characteristics of first midsole 202 and second midsole 802 may be substantially different. In some cases, first midsole 202 may have a first rigidity. Likewise, second midsole 802 may have a second rigidity. In some cases, the first rigidity may be substantially greater than the second rigidity. In other cases, the first rigidity may be substantially similar to the second rigidity. In one embodiment, the first rigidity may be substantially less than the second rigidity. For example, in cases where first midsole 202 and second midsole 802 both comprise foam midsoles, first midsole 202 may be made of a low density foam and second midsole 802 may be made of a high density foam. With this arrangement, insert assembly 171 is configured to provide increased cushioning for a foot, while insert assembly 181 provides increased energy return and firmness.

In some embodiments, one or more inserts could incorporate various kinds of bladders and/or fluid chambers. Generally, any kind of fluid bladder and/or fluid chamber known in the art could be used. Examples of fluid bladders that may be used in embodiments that include bladder and/or fluid chamber footwear components are disclosed in the following patents and patent applications: Swigart (U.S. Patent Publication Number 2012/0102782, published May 3, 2012), now U.S. patent application Ser. No. 12/938,175, filed Nov. 2, 2010; Chao et al. (U.S. Patent Publication Number 2012/0233880, published Sep. 20, 2012), now U.S. patent application Ser. No. 13/049,278, filed Mar. 16, 2011; Dojan et al. (U.S. Patent Publication Number 2012/0233879, published Sep. 20, 2012), now U.S. patent application Ser. No. 13/049,268, filed Mar. 16, 2011; Hazenberg et al. (U.S. Patent Publication Number 2012/0233878, published Sep. 20, 2012), now U.S. patent application Ser. No. 13/049,256, filed Mar. 16, 2011; Beye et al. (U.S. Pat. No. 8,470,113, issued Jun. 25, 2013), now U.S. patent application Ser. No. 12/778,921, filed May 12, 2010; Monfils et al. (U.S. Pat. No. 8,464,439, issued Jun. 18, 2013), now U.S. patent application Ser. No. 12/778,909, filed May 12, 2010; Passke, et al. (U.S. Pat. No. 7,210,249); Dojan, et al. (U.S. Pat. No. 7,409,779); Peyton (U.S. Pat. No. 8,479,412, issued Jul. 9, 2013), now U.S. patent application Ser. No. 12/630,642; Peyton (U.S. Pat. No. 8,381,418, issued Feb. 26, 2013), now U.S. patent application Ser. No. 12/777,167; Schindler (U.S. Pat. No. 7,131,218); Schindler et al. (U.S. Pat. No. 7,588,654); Schindler et al. (U.S. Pat. No. 7,591,919); Mitchell et al. (U.S. Pat. No. 5,713,141); Mitchell et al. (U.S. Pat. No. 5,952,065); Bonk et al. (U.S. Pat. No. 6,082,025); Bonk et al. (U.S. Pat. No. 6,127,026); Bonk et al. (U.S. Pat. No. 6,013,340); Bonk et al. (U.S. Pat. No. 6,203,868); Bonk et al. (U.S. Pat. No. 6,321,465); Rudy (U.S. Pat. No. 4,183,156); Rudy (U.S. Pat. No. 4,219,945); Dua et al. (U.S. Pat. No. 8,151,486, issued Apr. 10, 2012), now U.S. patent application Ser. No. 12/123,612; and Rapaport, et al. (U.S. Pat. No. 8,241,451, issued Aug. 14, 2012), now U.S. patent application Ser. No. 12/123,646. The entirety of all of the above patents or patent applications are hereby incorporated by reference. Furthermore, the number, geometry and locations of one or more bladders could be varied from one embodiment to another.

In some embodiments, first midsole 202 may comprise a substantially monolithic portion. In other cases, however, first midsole 202 could incorporate one or more fluid bladders that provide regions of varying density. In one embodiment, first midsole 202 includes first portion 1310 having a first density and second portion 1312 having a second density. In some cases, the second density may be substantially greater than the first density. In other cases, the first density may be substantially similar to the second density. In one embodiment, the first density may be substantially greater than the second density. For example, in one embodiment, first portion 1310 comprises a foam-like material while second portion 1312 comprises a fluid bladder 1302. Fluid bladder 1302 can increase cushioning and enhance comfort for a user.

In some embodiments, second midsole 802 may comprise a substantially monolithic portion having an approximately constant density. For example, in one embodiment, second midsole 802 comprises a substantially monolithic material that extends from forefoot portion 30 to heel portion 34. In embodiments where a substantially rigid material is used, such as a rigid foam, this provides for increased energy return and firmness.

An article can include provisions for allowing a user to easily determine what kind of insert assembly is disposed in an outer assembly. In some embodiments, an insert system could include one or more apertures. In some cases, an outer sole portion could include one or more apertures through which a portion of an insert assembly can be viewed. Additionally, in some cases, each different type of insert assembly can be associated with distinguishing features, such as different colors or distinguishing marks.

Figure 14:
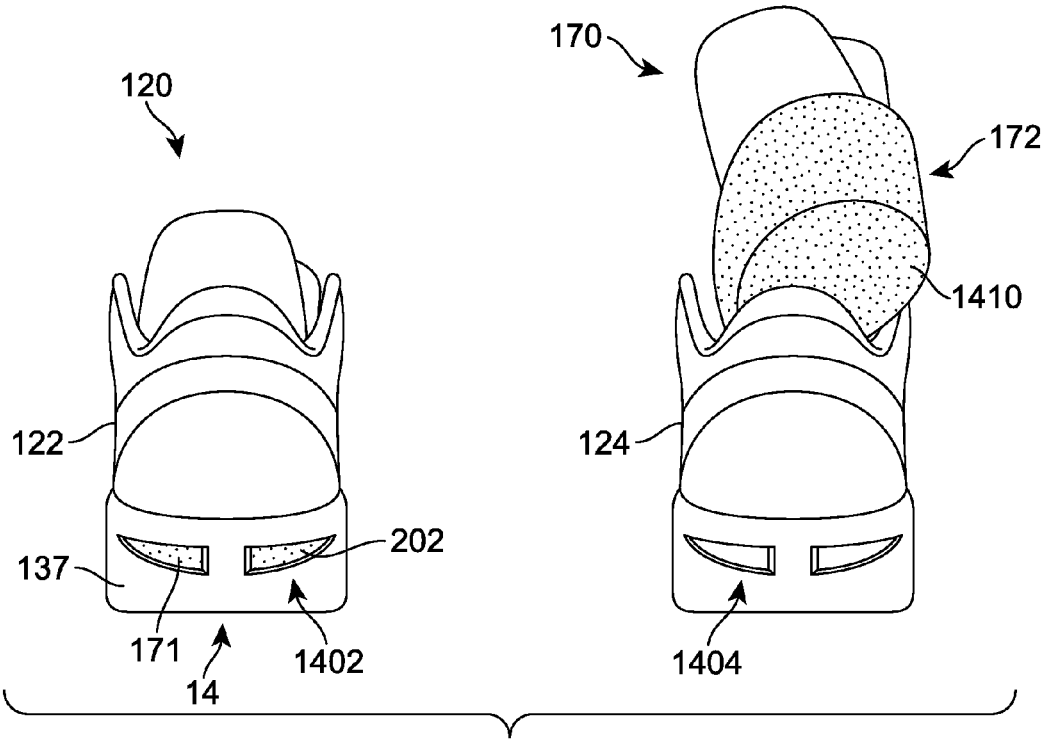
FIG. 14 is a rear view of an embodiment of a pair of outer assemblies with apertures on an outer sole portion.
Figure 15:
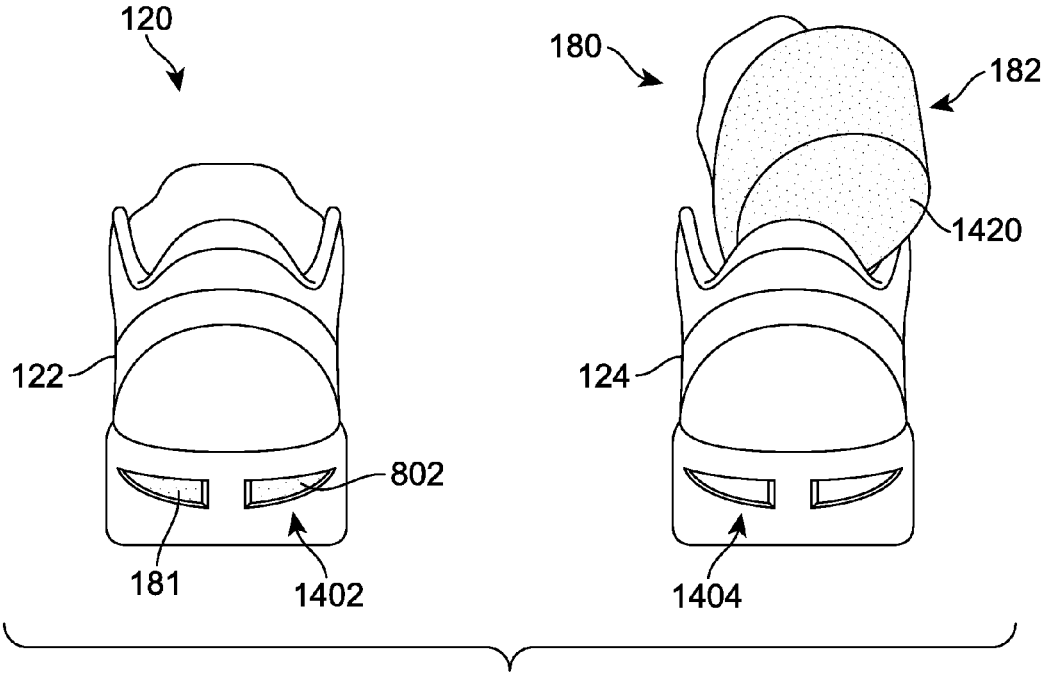
FIG. 15 is a rear view of an embodiment of a pair of outer assemblies with apertures on an outer sole portion.

FIGS. 14 and 15 illustrate rear views of an embodiment outer assembly 122 and outer assembly 124 with different insert assemblies. In particular, FIG. 14 illustrates an embodiment of first pair of insert assemblies 170 inserted into outer assemblies 120 while FIG. 15 illustrates an embodiment of second pair of insert assemblies 180 inserted into outer assemblies 120.

As seen in FIGS. 14 and 15, first outer assembly 122 and second outer assembly 124 each include a pair of apertures. For example, first outer assembly 122 includes first pair of apertures 1402 and second outer assembly 124 includes second pair of apertures 1404. Although the current embodiment includes two apertures on each outer assembly, in other embodiments each outer assembly could include a single aperture. In still other embodiments, each outer assembly could include three or more apertures.

Generally, the location of one or more apertures could vary. In some cases, one or more apertures could be disposed in an outer sole portion of an outer assembly. In some cases, one or more apertures could be disposed in a forefoot portion of an outer sole portion. In other cases, one or more apertures could be disposed in a midfoot portion of an outer sole portion. In still other cases, one or more apertures could be disposed in a heel portion of an outer sole portion. In still other cases, one or more apertures could be disposed on a bottom surface of an outer sole portion. In still other cases, one or more apertures could be disposed on a sidewall portion of an outer sole portion. In still other embodiments, one or more apertures could be disposed on an upper portion of an outer assembly. In one embodiment, first pair of apertures 1402 may be disposed on outer sidewall portion 137 of outer sole portion 134 at heel portion 14. Likewise, second pair of apertures 1404 may be disposed in a similar location on outer assembly 124.

In different embodiments, the shape of an aperture could vary. In some cases, an aperture could have an approximately triangular shape. In other cases, an aperture could have a rounded shape. In still other cases, an aperture could have an approximately polygonal shape. In still other cases, an aperture could have any other shape including a regular shape or an irregular shape. Moreover, in some cases, different apertures could have different shapes. In one embodiment, first pair of apertures 1302 and second pair of apertures 1304 have approximately triangular shapes.

In one embodiment, the midsoles of each different type of insert assembly may have different colors to allow a user to more easily distinguish between the different insert assemblies. For example, in one embodiment, first midsole 202 of first insert assembly 171 may be colored a first color (as seen through apertures 1402). In some cases, midsole 1410 of second insert assembly 172 may also be colored the first color. Additionally, second midsole 802 of first insert assembly 181 may be colored a second color (as seen through apertures 1402). In some cases, midsole 1420 of second insert assembly 172 may also be colored the second color. This allows each pair of insert assemblies to be easily distinguished according to the color of the corresponding midsoles. For example, in one embodiment, first pair of insert assemblies 170 may be associated with blue midsoles, while second pair of insert assemblies 180 may be associated with yellow midsoles. In other embodiments, however, any other colors could be used for the midsoles of each insert assembly. Moreover, in other cases, distinguishing marks that would be visible through first pair of apertures 1302 and second pair of apertures 1304 could be used.

In FIG. 14, first pair of insert assemblies 170 is inserted into first outer assembly 122 and second outer assembly 124. At this point, second insert assembly 172 is only partially inserted into second outer assembly 124. In this case, first insert assembly 171 has been fully inserted into first outer assembly 122 and is visible through first pair of apertures 1402. In FIG. 15, second pair of insert assemblies 180 is inserted into first outer assembly 122 and second outer assembly 124. At this point, second insert assembly 182 is only partially inserted into second outer assembly 124. In this case, first insert assembly 181 has been fully inserted into first outer assembly 122 and is visible through first pair of apertures 1402. As seen in FIGS. 14 and 15, it is possible to quickly distinguish between the two different insert assemblies by viewing the color appearing within first pair of apertures 1402 and/or second set of apertures 1404. This allows a user to quickly determine which type of inserts are already inside a pair of footwear.

Figure 16:
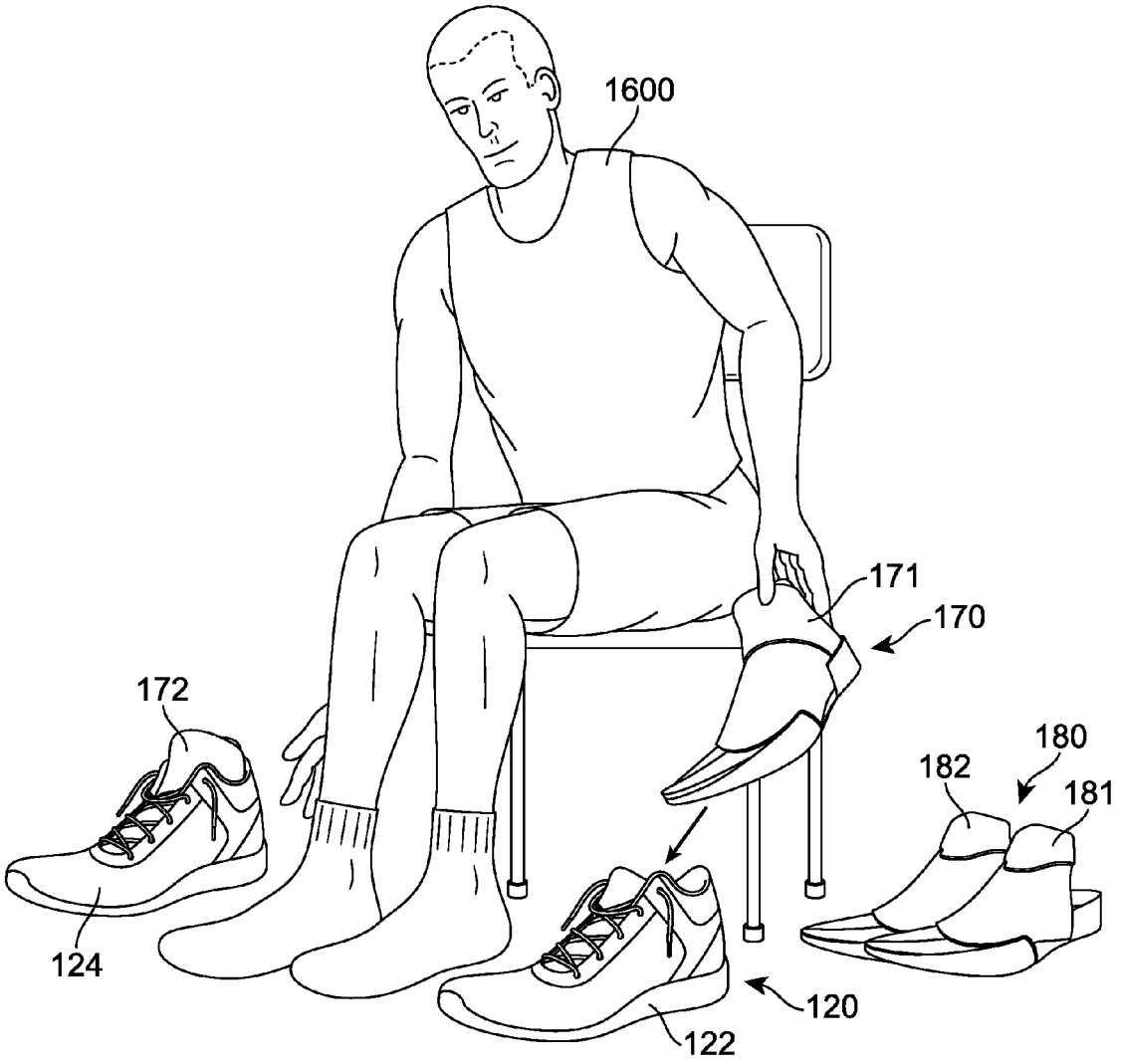
FIG. 16 is a view of an embodiment of a user inserting an insert assembly into an outer assembly.

FIG. 16 illustrates an embodiment of a user 1600 preparing for a basketball game. User 1600 has the choice of equipping outer assembly 122 and outer assembly 124 with first pair of insert assemblies 170 or second pair of insert assemblies 180. In this case, user 1600 is aware that he will be playing a grind-it-out kind of game that requires a great deal of posting up and/or pivoting movements. In order to receive the desired support, cushioning, comfort and proprioception from the footwear, user 1600 selects first pair of insert assemblies 170. On another occasion, in which user 1600 may play an opponent that likes to run up and down the court a lot, user 1600 could opt for second pair of insert assemblies 180 instead, which may provide footwear characteristics similar to those provided by a track shoe.

This arrangement reduces the need for a user to purchase different pairs of footwear for different footwear characteristics. Instead, the user can simply interchange one type of insert assembly configured to enhance a first set of footwear characteristics with another type of insert assembly configured to enhance a second, and possibly different, set of footwear characteristics. In addition to reducing the overall cost for the user, this system provides convenience for a user by reducing the number of pairs of footwear that must be carried around by the user.

In different embodiments, the materials utilized in constructing various components and structures may vary. For example, a sleeve member could be constructed of any kind of material, including but not limited to various kinds of textiles. Textiles are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven fabric. The textiles may incorporate fibers that are arranged to impart one-directional stretch or multi-directional stretch, and the textiles may include coatings that form a breathable and water-resistant barrier, for example. Examples of textile materials that could be used include, but are not limited to: animal textiles, such as wools and silks, plant textiles, such as cotton, flax, and lyocell, synthetic textiles such as polyester, aramid, acrylic, nylon, spandex, olefin fiber, ingeo, lurex and carbon fibers. In other embodiments, materials used for making a sleeve member could include non-woven fabrics, polymer layers, natural leathers, synthetic leathers as well as any other materials. In one embodiment, a sleeve member can be made of neoprene. Moreover, different insert assemblies could utilize different materials for a sleeve member to provide variations in elasticity, cushioning and proprioception provided by a sleeve member.

Midsoles could be made of any materials known in the art for use in sole structures. In some embodiments, a midsole may be made of a material that is configured to absorb forces applied by a foot. Examples of such materials include, but are not limited to: foams, including polyurethane foams, elastomers, rubbers as well as any other materials. As previously discussed, in some cases, different insert assemblies can utilize different midsole materials to provide variations in cushioning, comfort and/or durability.

Although the current embodiments illustrate an interchangeable insert system with two different insert assemblies, other embodiments could incorporate a different number of insert assemblies. In another embodiment, a single insert assembly could be used with an outer assembly. In still other embodiments, three or more insert assemblies could be used, where each insert assembly is configured to provide different footwear characteristics.

The description provided above is intended to illustrate some possible combinations of various features associated with an interchangeable insert system. Those skilled in the art will understand, however, that within each embodiment, some features may be optional. Moreover, different features discussed in different embodiments could be combined in still other embodiments and would still fall within the scope of the attached claims. Some features could be used independently in some embodiments, while still other features could be combined in various different ways in still other embodiments.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A kit of parts, comprising:

an outer assembly including an upper portion and an outer sole portion;

the upper portion including an opening and a fastening region, wherein the fastening region can be used to change the size of the opening;

the outer assembly configured to separately receive at least two different removable insert assemblies, wherein the at least two different removable insert assemblies are configured to be interchangeable with the outer assembly to provide an article of footwear having different footwear characteristics associated with each of the at least two different removable insert assemblies, the at least two different removable insert assemblies comprising:

a first insert assembly including a first sleeve member and a first midsole, wherein the first insert assembly can be removably inserted into the outer assembly;

a second insert assembly including a second sleeve member and a second midsole, wherein the second insert assembly can be removably inserted into the outer assembly, and wherein the second sleeve member is different from the first sleeve member;

the first sleeve member including a strap that can be used to adjust the fit of the sleeve member to a foot;

wherein the first sleeve member has a first tongue portion and wherein the first tongue portion is covered by the strap when the strap is fastened;

wherein the second sleeve member has a second tongue portion; and wherein the second sleeve member is free of a strap in the second tongue portion;

wherein the first insert assembly inserted within the outer assembly is configured to provide an article of footwear having a first set of footwear characteristics; and wherein the second insert assembly inserted within the outer assembly is configured to provide an article of footwear having a second set of footwear characteristics, the first set of footwear characteristics being different from the second set of footwear characteristics.

2. The kit of parts according to claim 1, wherein the first tongue portion has a first thickness, wherein the second tongue portion has a second thickness and wherein the second thickness is greater than the first thickness.

3. The kit of parts according to claim 1, wherein the strap of the first sleeve member extends from a heel portion of the sleeve member.

4. The kit of parts according to claim 3, wherein the second sleeve member lacks a heel portion.

5. The kit of parts according to claim 1, wherein the first sleeve member is configured to provide more ankle support than the second sleeve member.

6. The kit of parts according to claim 1, wherein the second sleeve member is configured to provide more proprioception at the midfoot than the first sleeve member.

7. An article of footwear, comprising:

an outer assembly including an upper portion and an outer sole portion, the upper portion further including an opening;

a sleeve member configured to be removably inserted into the opening;

the sleeve member including a midfoot portion configured to cover a midfoot of a foot;

wherein the sleeve member is open forwards of the midfoot portion;

wherein the sleeve member is open rearwards of the midfoot portion;

wherein the article of footwear further includes a midsole having an inner surface and an opposite outer surface;

wherein the sleeve member and the midsole comprise an insert assembly that can be removably inserted into the outer assembly; and wherein the sleeve member includes a lower extending portion that wraps around the outer surface of the midsole.

8. The article of footwear according to claim 7, wherein the sleeve member has a tongue portion and where the tongue portion is substantially thicker than the midfoot portion.

9. The article of footwear according to claim 7, wherein the midsole comprises a raised perimeter portion that extends around the midsole from a heel portion to a forefoot portion.

10. The article of footwear according to claim 9, wherein the raised perimeter portion tapers in height from the heel portion to the forefoot portion.

11. The article of footwear according to claim 7, wherein a forward most edge of the sleeve member extends rearwardly of a forward most edge of the midsole.

12. The article of footwear according to claim 7, wherein a rearward most edge of the sleeve member extends forwards of a rearward most edge of the midsole.

13. The article of footwear according to claim 7, wherein the insert assembly further comprises an insole and wherein the insole is disposed on the midsole.

* * * * *